US009200388B1

(12) United States Patent
Gallmeyer et al.

(10) Patent No.: US 9,200,388 B1
(45) Date of Patent: Dec. 1, 2015

(54) BI-TAPERED SPOOL FOR WIRE BRAIDING MACHINES

(71) Applicant: FORT WAYNE METALS RESEARCH PRODUCTS CORPORATION, Fort Wayne, IN (US)

(72) Inventors: Jeffery L. Gallmeyer, Roanoke, IN (US); Mark S. Michael, Corunna, IN (US); Jason W. Ferens, Fort Wayne, IN (US)

(73) Assignee: Fort Wayne Metals Research Products Corporation, Fort Wayne, IN (US)

( * ) Notice: Subject to any disclaimer, the term of this patent is extended or adjusted under 35 U.S.C. 154(b) by 193 days.

(21) Appl. No.: 13/839,743

(22) Filed: Mar. 15, 2013

Related U.S. Application Data

(60) Provisional application No. 61/636,176, filed on Apr. 20, 2012.

(51) Int. Cl.
*D04C 3/16* (2006.01)
*B65H 54/02* (2006.01)
*B65H 75/02* (2006.01)

(52) U.S. Cl.
CPC *D04C 3/16* (2013.01); *B65H 54/02* (2013.01); *B65H 75/02* (2013.01)

(58) Field of Classification Search
CPC ..... D04C 3/16
See application file for complete search history.

(56) References Cited

U.S. PATENT DOCUMENTS

| | | | | | |
|---|---|---|---|---|---|
| 13,391 | A | * | 8/1855 | Hull | 87/22 |
| D1,926 | S | | 3/1864 | Ives | |
| 88,956 | A | * | 4/1869 | Greenhalgh | 87/22 |
| 520,189 | A | | 5/1894 | Roehm | |
| 694,536 | A | * | 3/1902 | Diss | 87/22 |
| 843,190 | A | | 2/1907 | Wilson | |
| 1,149,088 | A | * | 8/1915 | Schmachtl | 87/22 |
| 1,172,719 | A | * | 2/1916 | Littlefield | 87/22 |
| 1,488,032 | A | * | 3/1924 | Chace | 87/22 |
| 1,609,304 | A | * | 12/1926 | Perron | 87/22 |
| 1,781,135 | A | * | 11/1930 | Sladek et al. | 87/22 |
| 1,838,172 | A | * | 12/1931 | Chace | 87/22 |
| 1,841,191 | A | * | 1/1932 | Larson | 87/22 |

(Continued)

FOREIGN PATENT DOCUMENTS

| | | | |
|---|---|---|---|
| DE | 4001250 | A1 | 7/1991 |
| GB | 2079247 | A | 1/1982 |
| JP | 57137271 | A | 8/1982 |

OTHER PUBLICATIONS http://www.globalbraid.com/product-Bobbin-Carrier.html, Apr. 22, 2012.*

*Primary Examiner* — Shaun R Hurley
(74) *Attorney, Agent, or Firm* — Faegre Baker Daniels LLP

(57) ABSTRACT

A spool for use in a wire braiding machine, for example, which has a "bi-tapered" design including a central cylindrical section and a pair of tapered (e.g., frusto-conical or parabolic) flanges having surfaces that slope inwardly toward the cylindrical section. In this manner, the spool provides a progressively widening wire fill area, as measured along a direction parallel to the rotational axis of the bobbin, as the wound wire advances progressively radially outwardly from the cylindrical section. This widening wire fill area aids in preventing the formation, propagation and buildup of wire winding defects, such that the wire is more likely to unspool or pay-out from the spool without losing tension, snagging or breaking.

19 Claims, 18 Drawing Sheets

(56) References Cited

U.S. PATENT DOCUMENTS

| | | | | | |
|---|---|---|---|---|---|
| 2,058,918 | A | * | 10/1936 | Scott et al. | 87/18 |
| 2,167,930 | A | * | 8/1939 | Krissiep | 87/18 |
| 2,264,116 | A | | 11/1941 | Howsam | |
| 2,486,514 | A | | 11/1949 | Boehnke | |
| 3,176,932 | A | | 4/1965 | Kovaleski | |
| 3,357,169 | A | | 12/1967 | Bigiel | |
| 3,686,997 | A | * | 8/1972 | Strangfeld et al. | 87/57 |
| 3,717,315 | A | | 2/1973 | Kovaleski | |
| 4,140,289 | A | | 2/1979 | Kovaleski | |
| 4,269,371 | A | | 5/1981 | Kovaleski | |
| 4,471,920 | A | | 9/1984 | Ditton et al. | |
| 4,602,751 | A | | 7/1986 | Vogel | |
| 4,659,032 | A | | 4/1987 | Rottleb | |
| 5,195,699 | A | * | 3/1993 | Stinnette | 242/322 |
| 5,330,127 | A | | 7/1994 | Hafner | |
| 5,732,611 | A | * | 3/1998 | Voyer et al. | 87/56 |
| 5,913,959 | A | * | 6/1999 | Klein et al. | 87/44 |
| 5,974,938 | A | * | 11/1999 | Lloyd | 87/56 |
| 6,810,785 | B2 | * | 11/2004 | Chen | 87/56 |
| 7,464,633 | B1 | * | 12/2008 | Kao | 87/55 |

* cited by examiner

BI-TAPERED SPOOL FOR WIRE BRAIDING MACHINES

CROSS REFERENCE TO RELATED APPLICATIONS

The present application claims the benefit under Title 35, U.S.C. Section 119(e) of U.S. Provisional Patent Application Ser. No. 61/636,176, filed Apr. 20, 2012 and entitled BI-CONICAL SPOOL FOR WIRE BRAIDING MACHINES, the entire disclosure of which is hereby expressly incorporated herein by reference.

BACKGROUND

1. Technical Field

The present disclosure relates to spools or bobbins for use with wire braiding machines, for example and, in particular, relates to an improved spool having a design which is useful for preventing snagging of wire upon pay-off of the wire from the spool during operation of a wire braiding machine.

2. Description of the Related Art

A schematic view of wire braiding machine 10 is shown in FIG. 1, including rotatable carousel 12 holding a plurality of spools 14 each containing a fine diameter wire 16 wound around spools 14. During operation of braiding machine 10, constituent wires 16 pay-off from their respective spools 14, with spools 14 rotating about their respective axes while being simultaneously orbited about a longitudinal axis of the machine 10. This orbiting motion is effected by carousel 12, which rotates to braid constituent wires 16 about a central mandrel wire 18 paid off from a mandrel wire spool 19. After wires 16 are braided around mandrel wire 18 to form a length of a braided wire construct 20 which may be rewound onto takeup spool 21. When ready for use in a medical device such as a catheter, for example, mandrel 18 may be withdrawn from a length of the braided constituent wires 16, such that the resulting braided wire construct forms a hollow, braided tube of wire material.

Spool 14 is shown in further detail in FIG. 2, and includes a central cylindrical barrel 22 and a pair of substantially cylindrical wire-retention flanges 24 on respective opposite sides of barrel 22. Flanges 24 define generally planar inwardly-facing end surfaces disposed perpendicular to longitudinal axis $L_P$-$L_P$ of barrel 22. One of flanges 24 includes a plurality of ratchets 26 annularly arranged around axis $L_P$-$L_P$ and adapted to interface with correspondingly formed ratchet structures (not shown) on carousel 12 of braiding machine 10. The spool 14 may be small in size, having an overall width $W_P$ of about 35.5 mm and a flange diameter $D_P$ of 40 mm.

One problem with the function and structure of spool 14 is schematically illustrated in FIG. 3. When wire 16 is wound onto spool 14, any winding errors or unevenness in the level of the wire winding tends to build and propagate as spool 14 is filled. For example, referring to FIG. 3, a wire build-up indicated at 28 at the right side of spool 14 near the right flange 24 is visible. Winding defects such as build-up 28 can cause snagging and/or breakage of the wire 16 upon pay-out during operation of the braiding machine 10, which in turn disrupts the continuity of braided construct 20 and necessitates shutdown of machine 10 and replacement of spool 14. These consequences, in turn, may impedes production of construct 20, generates waste and may result in suboptimal mitigation strategies by the machine operator, such as using spools 14 that are less than completely filled with wound constituent wire 16.

What is needed is an improvement over the foregoing.

SUMMARY

The present disclosure provides a spool for use in a wire braiding machine, for example, the spool having a "bi-tapered" design including a central cylindrical section and a pair of tapered (e.g., frusto-conical or parabolic) flanges having surfaces that slope inwardly toward the cylindrical section. In this manner, the spool provides a progressively widening wire fill area, as measured along a direction parallel to the rotational axis of the bobbin, as the wound wire advances progressively radially outwardly from the cylindrical section. This widening wire fill area aids in preventing the formation, propagation and buildup of wire winding defects, such that the wire is more likely to unspool or pay-out from the spool without losing tension, snagging or breaking.

In one form thereof, the present disclosure provides a braiding machine comprising: a mandrel wire payout assembly including a mandrel wire spool rotatably mounted to a first spool support; a mandrel wire guide positioned to receive a mandrel wire from the mandrel wire payout assembly, such that a mandrel wire path includes an upstream origin at the mandrel wire payout assembly and a downstream portion passing through the mandrel wire guide; a braid takeup assembly disposed downstream of the mandrel wire guide, the braid takeup assembly including a braid takeup spool rotatably mounted to a second spool support; a plurality of payout assemblies rotatably arranged around the mandrel wire guide, each of the plurality of payout assemblies comprising: a payout arm; a constituent wire guide disposed downstream of the payout arm, the constituent wire guide positioned to guide a constituent wire of a braided wire construct from the payout arm to the mandrel wire path downstream of the mandrel wire guide; and a ratcheting mechanism disposed adjacent one end of the payout arm; and a spool rotatably mountable to one of the plurality of payout assemblies, the spool comprising: a barrel having a central bore defining a longitudinal axis, the central bore sized to be received on the payout arm; a pair of tapered sections extending axially away from respective opposing axial ends of the barrel to define a pair of opposed flanges of the spool, the barrel and the pair of tapered sections defining a wire spooling volume of the spool; and a plurality of ratchet teeth formed on an axial end surface of one of the pair of tapered sections, the ratchet teeth adapted to selectively engage the ratcheting mechanism of the payout assembly.

In another form thereof, the present disclosure provides a wire spool comprising: a cylindrical barrel defining a longitudinal axis; a pair of tapered flanges extending axially away from respective opposing axial ends of the cylindrical barrel, the pair of tapered flanges cooperating with the cylindrical barrel to define a wire spooling volume between 0.623 cubic inches and 1.840 cubic inches; a quantity of wire wound around the cylindrical barrel to form a plurality of layers extending progressively radially outwardly from the longitudinal axis, the plurality of layers respectively extending between and abutting the pair of tapered flanges, the quantity of wire having a length of at least 1,000 feet.

In yet another form thereof, the present disclosure provides a spool for use in holding wire, the spool comprising: a cylindrical barrel defining a longitudinal axis; a pair of tapered flanges extending axially away from respective opposing axial ends of the cylindrical barrel to define an overall diameter of the spool, the pair of tapered flanges cooperating to defining a wire spooling volume of the spool between 0.623 cubic inches and 1.840 cubic inches; and a plurality of ratchet teeth formed on an axial end surface of one of the pair of tapered flanges, the ratchet teeth adapted to engage an anti-backlash ratcheting mechanism of a braiding machine to selectively prevent or permit rotation of the spool.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the disclosure in any manner.

DETAILED DESCRIPTION

The present disclosure provides a tapered spool or bobbin adapted to contain wound fine-diameter wire. This wire can be smoothly paid out to serve as a constituent braid wire wound around a wire mandrel in a braiding machine. More particularly, the tapered arrangement of the supporting walls of the spool minimizes or prevents snags or sudden changes in tension in the wire as it is paid out, enabling operation of the braiding machine without interruption.

1. Bobbin Design

Figure 4A:
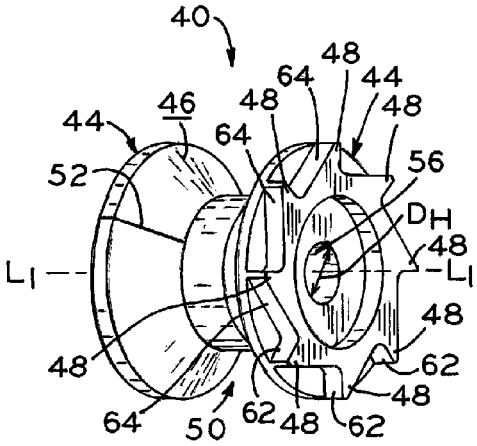
FIG. 4A is a perspective view of a spool made in accordance with the present disclosure.
Figure 4B:
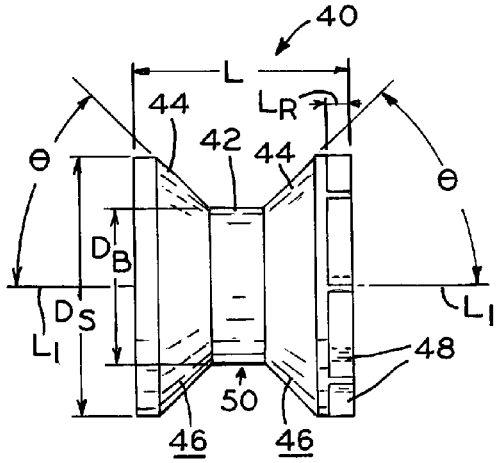
FIG. 4B is a side elevation view of the spool shown in FIG. 4A.
Figure 5:
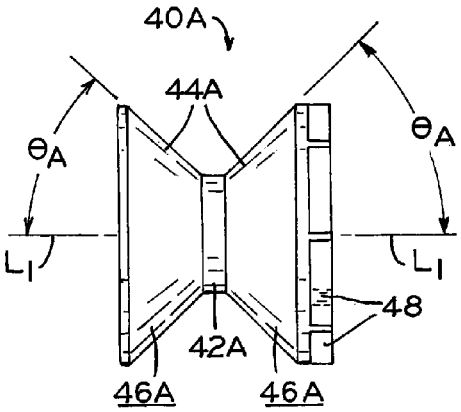
FIG. 5 is a side elevation view a small-barrel, 45-degree spool.
Figure 6:
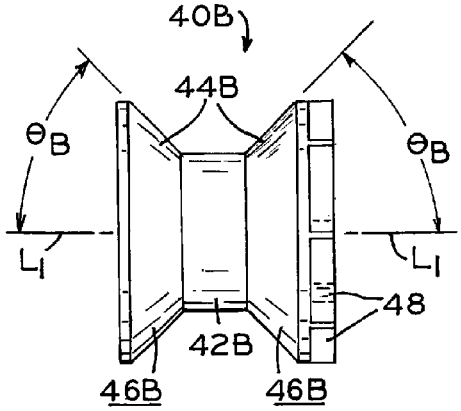
FIG. 6 is a side elevation view a large-barrel, 45-degree spool.
Figure 7:
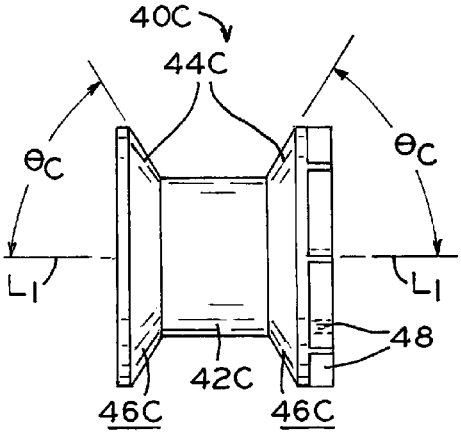
FIG. 7 is a side elevation view a large-barrel, 60-degree spool.
Figure 8:
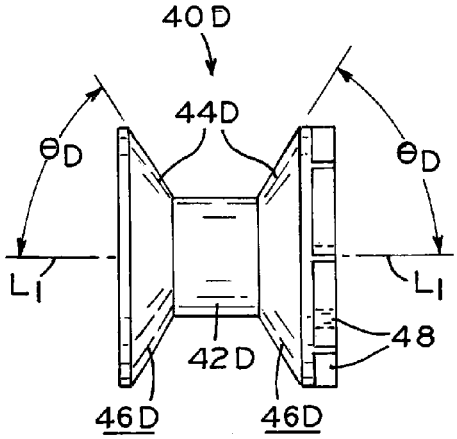
FIG. 8 is a side elevation view a small-barrel, 60-degree spool.
Figure 9:
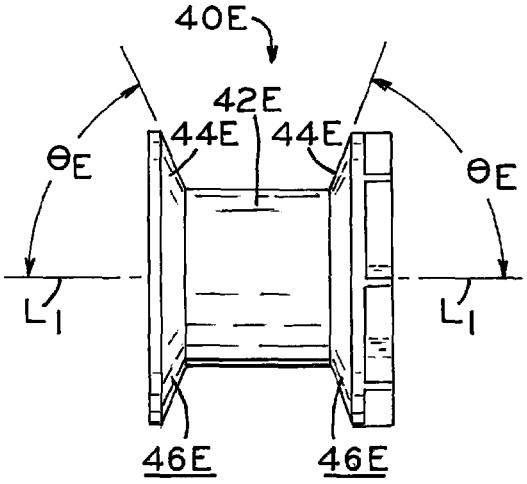
FIG. 9 is a side elevation view a large-barrel, 70-degree spool.
Figure 10:
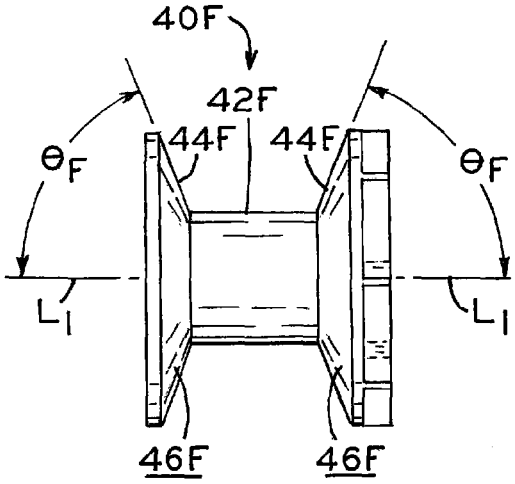
FIG. 10 is a side elevation view a small-barrel, 70-degree spool.

Referring now to FIGS. 4-11, various embodiments of spool or bobbin 40 according to the present disclosure are shown, each with a "bi-conical" or otherwise tapered design. FIG. 4 illustrates spool 40, which may take various forms and have various particular geometrical arrangements as illustrated in FIGS. 5-11. For purposes of the present disclosure, spool 40 and its associated structures are denoted with an appropriate letter designators for the various embodiments shown in FIGS. 5-11. Like reference numbers indicated like structures throughout the several views, and designation of a reference number without any associated letter designator is intended to generically refer to all embodiments. Thus, a reference to spool 40 includes any of spools 40A-40G shown in FIGS. 5-11, respectively.

Turning to FIG. 4, spool 40 has central cylindrical section or barrel 42 disposed along a longitudinal axis $L_1$-$L_1$, and a pair of tapered flanges 44 extending axially outwardly from respective opposite ends of barrel 42, such that the longitudinal cross-section of flanges 44 grows larger as surfaces 46 extend axially away from the respective adjoining ends of barrel 42. In an exemplary embodiment, surfaces 46 of flanges 44 are frusto-conical surfaces each defining angle $\Theta$ with respect to longitudinal axis $L_1$-$L_1$ of spool 40 and barrel 42.

Angle $\Theta$ may vary depending on what is required or desired for a particular application. In the exemplary embodiments of FIGS. 5 and 6, for example, angles $\Theta_A$ and $\Theta_B$ are each approximately 45 degrees with respect to longitudinal axis $L_1$-$L_1$. In the exemplary embodiments of FIGS. 7 and 8, angles $\Theta_C$ and $\Theta_D$ are each approximately 60 degrees. In yet other exemplary embodiments shown in FIGS. 9 and 10, angles $\Theta_E$ and $\Theta_F$ are each approximately 70 degrees. Moreover, angle $\Theta$ in accordance with the present disclosure may be as little as 35 degrees, 45 degrees or 50 degrees, or as much as 60 degrees, 70 degrees or 75 degrees, or may be any value within any range defined by any of the foregoing values.

In one exemplary embodiment, spool 40 defines a particular spatial envelope and functional features that are compatible with common braiding machines. More particularly, spool 40 defines a generally cylindrical outer spatial envelope, whose length is defined by the overall axial length L of spool 40 (FIG. 4B) and whose diameter is defined by the outer diameters $D_S$ of flanges 44. In an exemplary embodiment, the overall axial length L of spool 40 is 1.40 inches, and the diameter $D_S$ of flanges 44 is 1.69 inches. In addition, the axial extent $L_R$ of ratchets 48 is 0.156 inches. A maximum potential spooling volume 50 is defined as the maximum spooling length (equal to $L-L_R$, or 1.244 inches) multiplied by the area of the circular cross-section of the outer spatial envelope of spool 40 across the spooling length (equal to pi*$D_S$, or about 5.31 inches), minus the volume occupied by barrel 42 and flanges 44. Stated another way, when viewed from the side of spool 40 as in FIG. 4A, winding volume 50 of spool 40 is defined between the cylindrical barrel 42 and flanges 44 and extends radially outwardly from barrel 42 in a direction perpendicular to longitudinal axis $L_1$-$L_1$.

Figure 11:
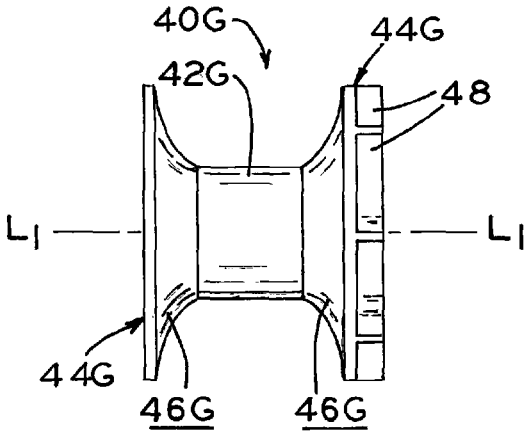
FIG. 11 is a side elevation view a small-barrel, 70-degree spool.

In the exemplary embodiments of FIGS. 5-11, all of spools 40A-40G have the same axial length L, diameter $D_S$, and ratchet length $L_R$, thereby enabling spools 40A-40G to be compatible with a certain class of braiding machine 100 as described in further detail below. Thus, spooling volume 50 for spools 40A-40G varies according to diameter $D_B$ of barrel 42 and the geometry of flange surfaces 46 of flanges 44. Generally speaking, a reduction in diameter $D_B$ and/or a steepening of angle Θ increases volume 50 and thereby also increases the length of wire that may be wound onto spool 40. As noted above, angle η may vary from 30 degrees to 80 degrees, with the exemplary embodiments of FIGS. 5-10 having angles $\Theta_A$-$\Theta_F$ that are 45, 60 or 70 degrees. As shown in FIG. 11, surfaces 46G of flanges 44G are parabolic in profile, and define a concave surface such that the axial cross-section taken through flanges 44G grows exponentially larger in diameter as such cross-section moves further away from respective axial ends of barrel 42G.

Figure 15:
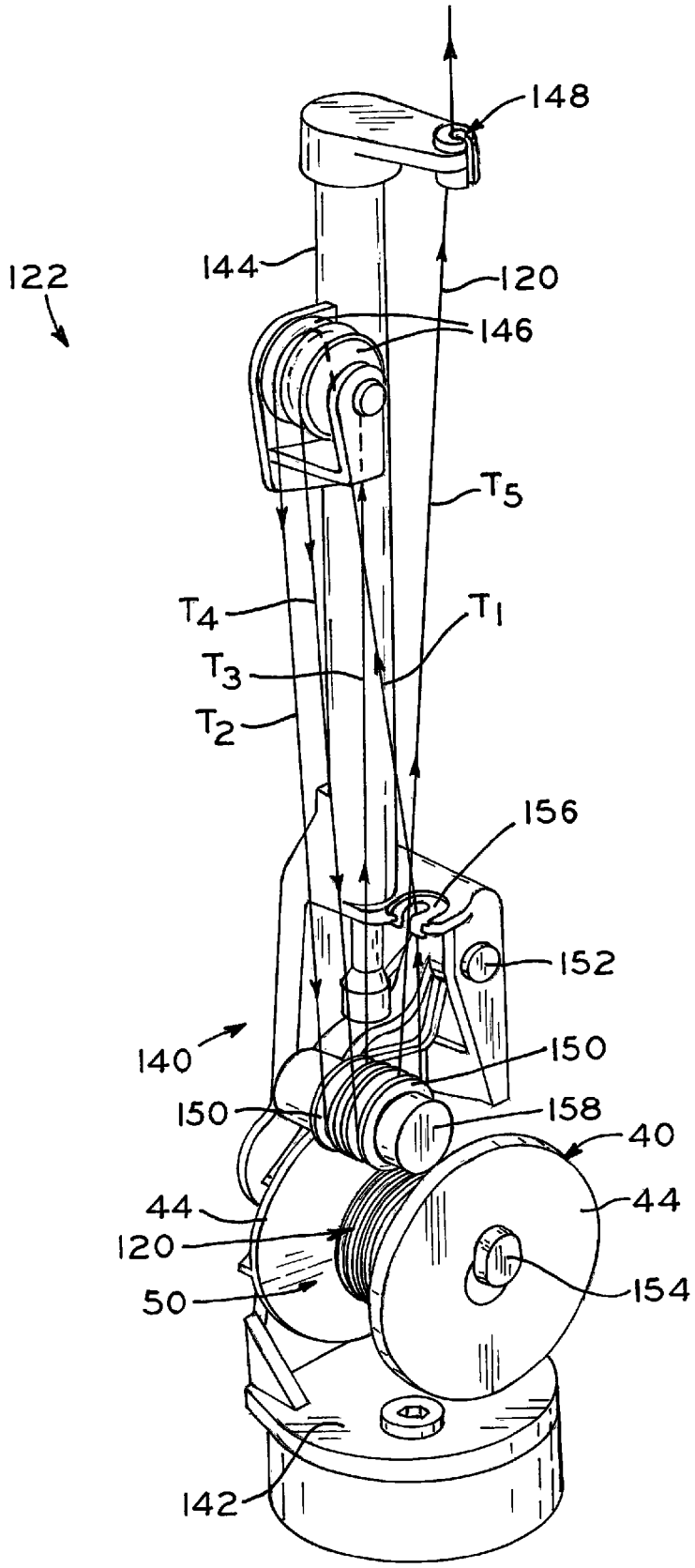
FIG. 15 is a perspective view of one of the constituent wire payout assemblies shown in FIG. 14.

In the exemplary embodiments of FIGS. 5-11, diameter $D_B$ of barrel 42 may have any nominal value, provided diameter $D_B$ is less than the overall diameter $D_S$ to provide at least some volume 50 for receipt of wire therein, and large enough to provide adequate supporting material around bore 60. In spool 40 may have a bore diameter $D_H$ of 0.415 inches, which is sized to rotatably mount spool 40 to payout arm 154 of wire payout assembly 122, as shown in FIG. 15 and further described below. In the exemplary embodiments of spools 40A-40G, barrels 42 may have outer diameters $D_B$ of as little as 0.625 inches, 0.756 inches, or 0.815 inches or as much as 1.02 inches, 1.25 inches or 1.40 inches, or may be any diameter within any range defined by any of the foregoing values. For purposes of the present examples, spools 40A, 40D, 40F and 40G have "small barrel" designs with respective barrel diameters $D_B$ equal to 0.756 inches, while spools 40B, 40C, and 40F have "large barrel" designs with respective barrel diameters $D_B$ equal to 1.02 inches.

The above exemplary sizes and geometries of spools give rise to a range of wire volumes 50 across spools 40A-40G. The largest volume among the illustrated embodiments is found in spool 40F having a small barrel 42F and steep angle $\Theta_F$, and is equal to about 1.657 cubic inches. The smallest volume among the illustrated embodiments is found in spool 40B having a large barrel 42B and nominally small angle $\Theta_B$, and is equal to about 1.121 cubic inches. In other exemplary embodiments utilizing wider ranges for barrel diameters DB and angle Θ, volume 50 may range from as little as 0.623 cubic inches to as much as 1.840 cubic inches. Constituent wires 120 are wound onto spools 40, as shown in FIGS. 3B and 15-17, to partially or fully occupy winding volume 50. Spool 40 may include slot 52 (FIG. 4A) in the non-ratcheting flange 44, which can be used to capture wire 120 at the start of winding the wire 120 about spool 40. As wire 120 is wound about spool 40, wire 120 winds in horizontally-progressing fill layers L which, when contacting surfaces 46 of flanges 44, are allowed to transition from a horizontal progression in one axial direction to a horizontal progression in the opposite axial direction, as illustrated. As this transition takes place wire 120 configures itself into a "nested" abutting relationship in which wire 120 is in secure contact with both surface 46 and the adjacent wire of radial inward layer L of wire 120 (which also contacts surface 46 as shown). Stated another way, wire 120 is prevented from becoming "perched" on the abutting wire of underlying layer L, in which case wire 120 might be able to "fall" off of its perched location either toward or away from the adjacent surface 46. If such a "fall" occurs, the tension imparted to wire 120 in the vicinity of the affected winding may be disrupted, falling below or rising above the tension in the other windings.

Rather, wire 120 is encouraged to be nested between surface 46 and the adjacent radially inward layer by the tapered arrangement of surface 46, because the adjacent radially inward layer L is axially displaced with respect to the next radially outward layer L. This avoidance of wire 20 shifting off of such a "perch" after it is wound on to spool 40, in turn, allows wire 120 to be wound onto spool 40 (and be subsequently unwound, as described below) in a non-abrupt manner, such that radially outward layers L of wire 120 on spool 40 are not frictionally or physically blocked from unwinding by any of the adjacent radially layers L. In addition, this secure nested arrangement of layers L helps to ensure constant tension throughout wire 120 when wound onto spool 40.

This nested, layered arrangement of wire 120 as it is wound onto spool 40 also facilitates efficient reversals of the horizontal progression of the layers L, such that wire 120 may continue to wind in a reversed, horizontally-progressing layer L on top of an underlying layer L. This process is repeated for a large number of layers as wire 120 is wound onto the spool 40. Because surfaces 46 of flanges 44 are tapered as described in detail above, each progressively radial outward layer L is slightly wider than the radial inward layers upon which it is wound, as illustrated in FIG. 3B.

The continuous widening (i.e., axial lengthening) of the winding volume 50 of spool 40 which is provided by the present tapered design aids in preventing the buildup of wire winding defects, as the axial length of winding volume 50 of spool 40 continually expands as spool 40 is filled with wire 120 wound onto spool 40. Thus, each layer L of wire 120 wound onto spool 40 have respective, substantially constant radial distances $D_{L1}$, $D_{L2}$, etc (FIG. 3B), as measured from longitudinal axis $L_1$-$L_1$, thereby promoting even tension when wire 120 is paid out from spool 40 as described further below.

Wire 120 may be, for example, round, flat, or hollow fine diameter wire for medical device applications, for example, wire having a diameter of 1.0 mm or less. In one exemplary embodiment, wire 120 may have a round cross-section with a diameter of 0.004 inches (0.10 mm) or less, and in some cases as little as 0.00075 inches (0.020 mm). In another exemplary embodiment, constituent wire 120 may have a rectangular cross-section with a height as large as 0.004 inches (0.10 mm) and a width as large as 0.012 inches (0.30 mm), or with a height as little as 0.0007 inches (0.018 mm) and a width of as little as 0.002 inches (0.05 mm).

When such exemplary wires 120 are wound onto the above-described exemplary spools 40, the total length of wire 120 containable within volume 50 may be as much as 1,000 feet, 3,000 feet, 9,150 feet, 88,000 feet or 260,300 feet, depending on the cross-sectional size and geometry of wire 120 and the geometry of spool 40.

Figure 16:
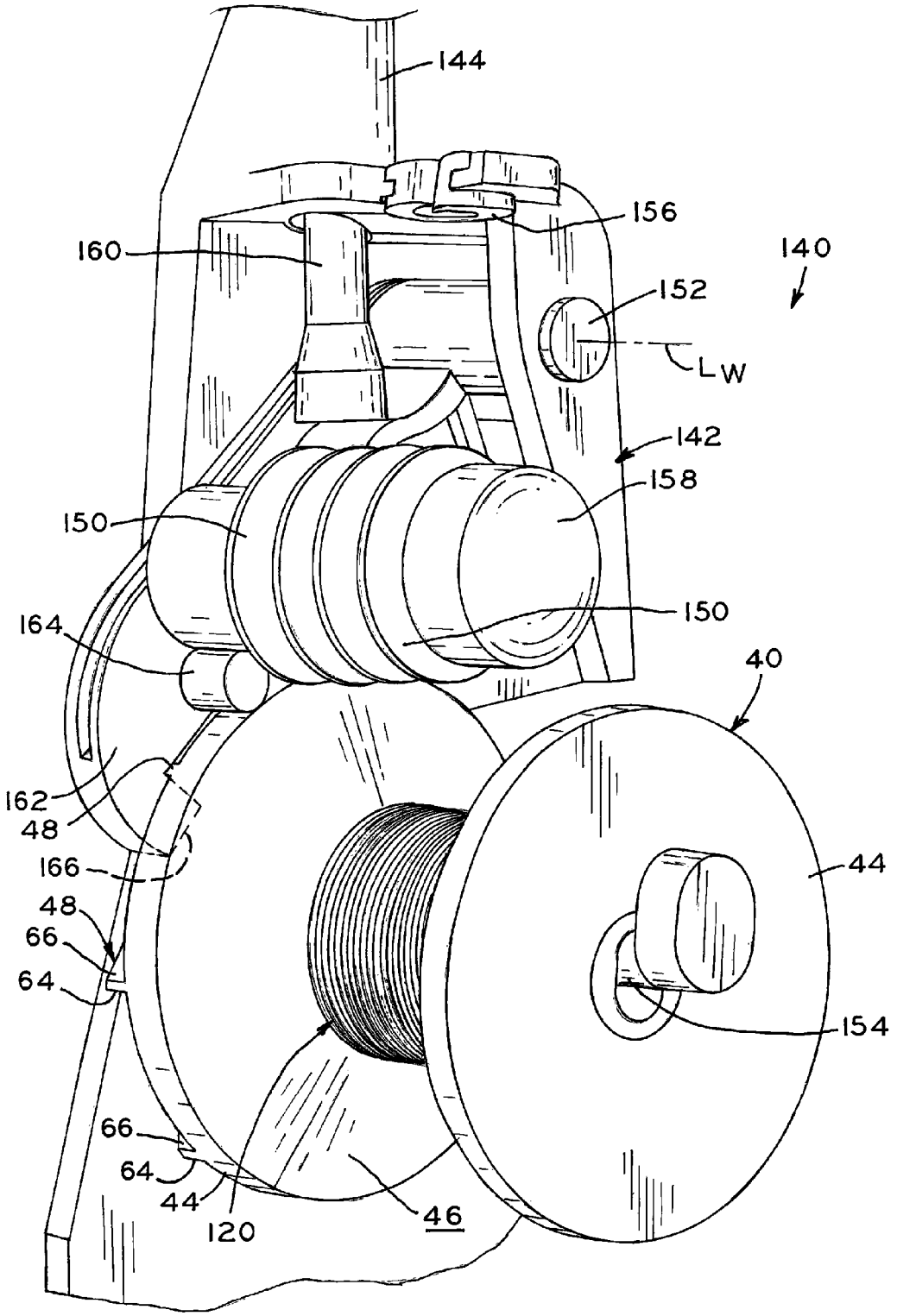
FIG. 16 is an enlarged perspective view of a wire payout control mechanism of the wire payout assembly shown in FIG. 15, shown in an at-rest configuration.
Figure 17:
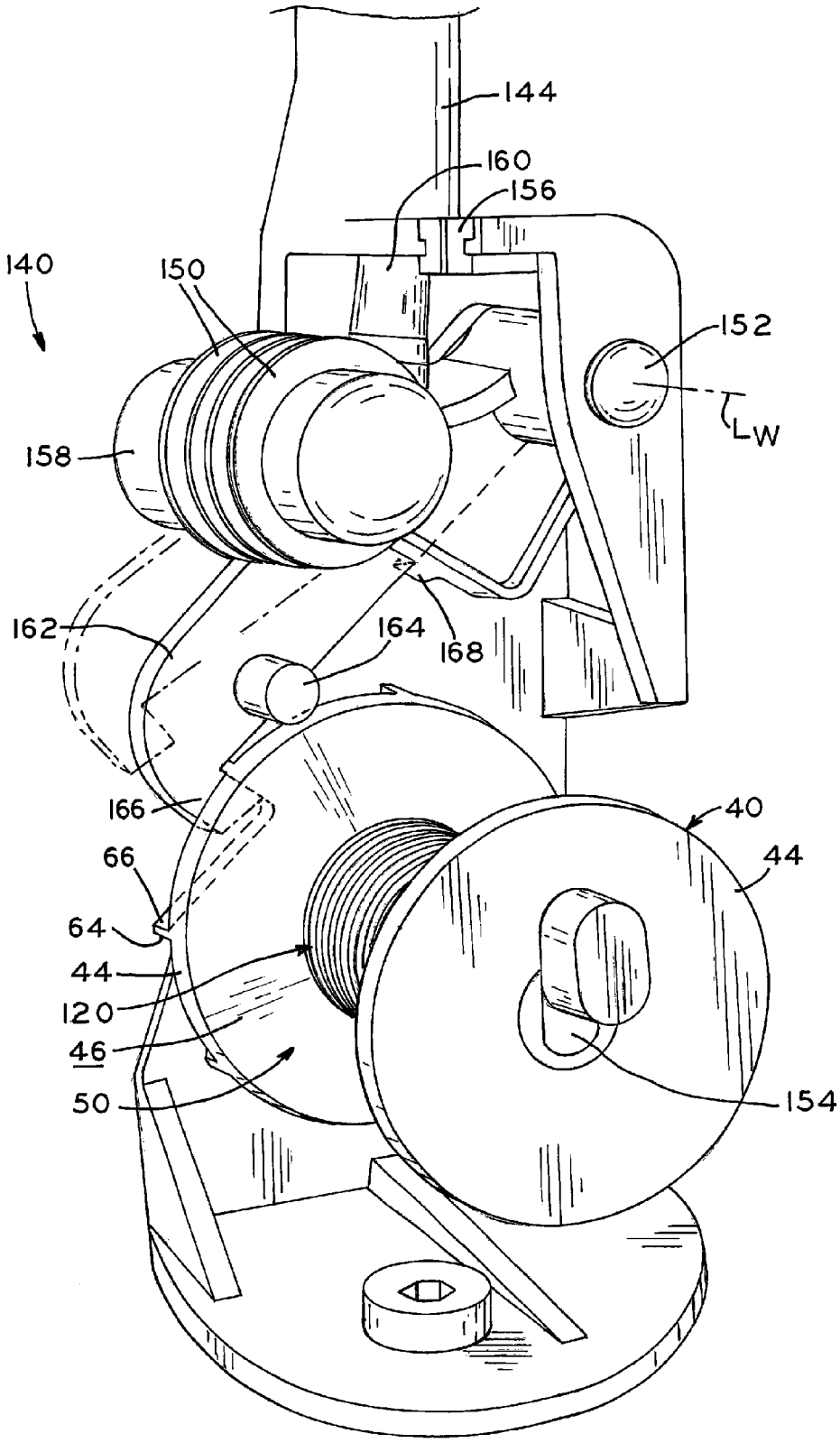
FIG. 17 is another perspective view of the control mechanism shown in FIG. 16, illustrating the mechanism in an actuated configuration.

As noted above and best shown in FIG. 4A, ratchets 48 are formed on flanges 44 at one axial end of spool 40, and are adapted to interface with braiding machine 100, as shown in FIGS. 12-17 and described in further detail below. Ratchets 48 are evenly radially spaced around the end surface of one of flanges 44, and each includes a stop face 64 and a ramped face 66. Stop face 64 defines a radial profile extending radially inwardly toward longitudinal axis $L_1$-$L_1$, and can therefore be contacted by a corresponding ratcheting structure (e.g., ratchet tooth 166 of ratchet arm 162 as shown in FIGS. 16 and 17) to prevent rotation of spool 40 when so engaged. During operation, the ratcheting structure is selectively withdrawn from contact with stop face 64 (as described below) to allow spool 40 to rotate and pay out wire 120. Ramped face 66 forms a "backside" of stop face 64, and funnels the ratcheting structure into contact with stop face 64 if the ratcheting structure descends between a neighboring pair of ratchets 48.

2. Braiding Operation

The reduction or prevention of wire winding defects enabled by the use of bobbin 40 facilitates payout of constituent wires 120 from spool 40 more efficiently when spool 40 is used in a braiding machine, such as braiding machine 10. This efficient payout reduces the likelihood that wire 120 will lose tension, snag or break as wire 120 is paid out from spool 40 during a braiding operation.

Figure 12:
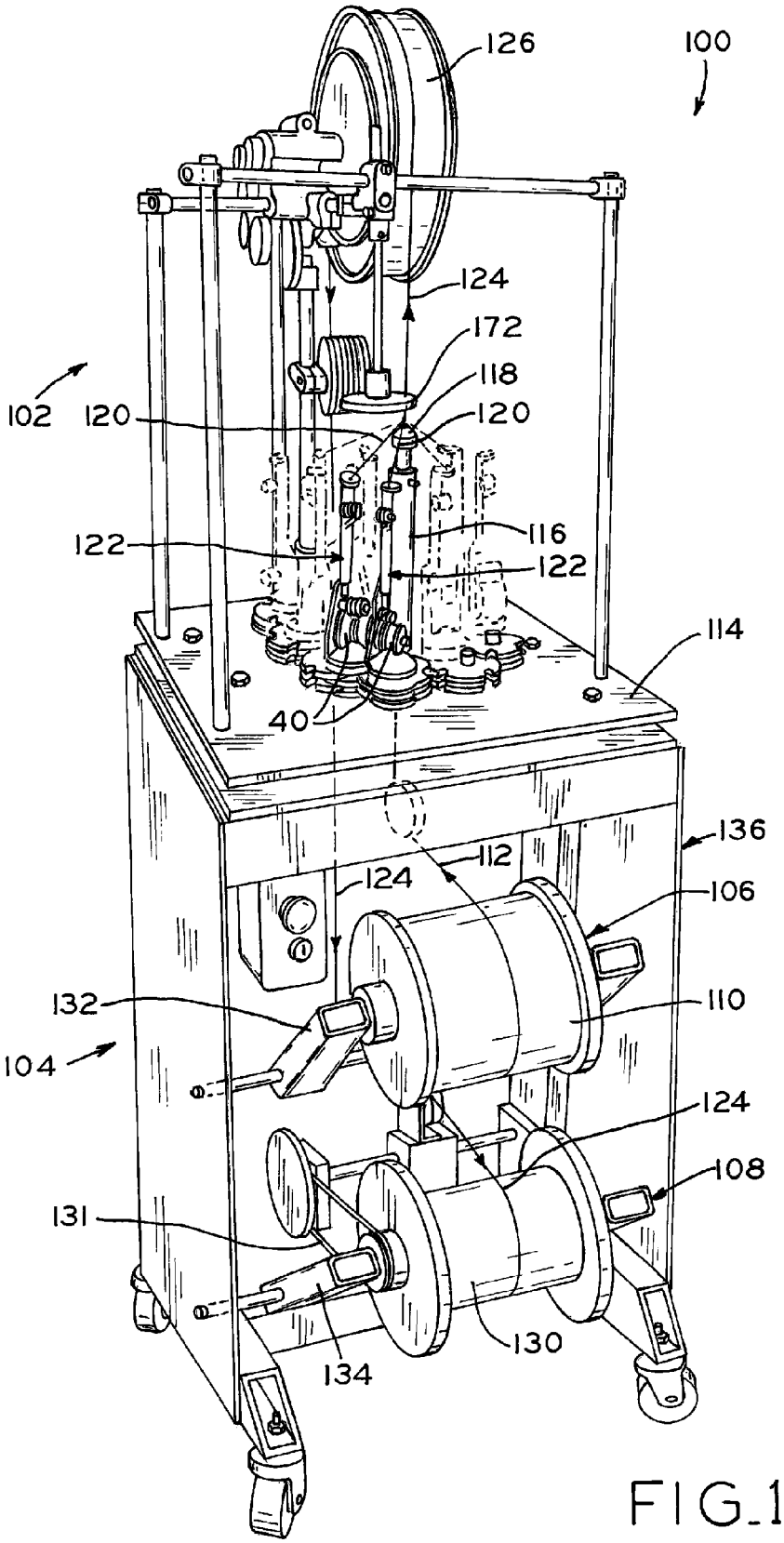
FIG. 12 is a perspective view of an exemplary braiding machine usable in conjunction with a bi-conical spool made in accordance with the present disclosure.

Turning now to FIG. 12, braiding machine 100 includes braiding portion 102 and payout/rewinding portion 104 having mandrel wire payout assembly 106 and braid takeup assembly 108. Mandrel wire payout assembly 106 includes mandrel wire spool 110, which feeds mandrel wire 112 through base plate 114 and into mandrel wire guide 116 of braiding portion 102. As mandrel wire 112 emerges from outlet 118 of mandrel wire guide 116, a plurality of constituent braid wires 120 intersect the outer surface of mandrel wire 112. As described in further detail below, constituent braid wires 120 are paid out from bobbins 40, which are rotatably mounted to constituent wire payout assemblies 122 arranged around wire guide 116.

As mandrel wire 112 advances in a downstream direction away from outlet 118 of wire guide 116, constituent wire payout assemblies 122 feed constituent braid wires 120 downstream as braid wires 120 are wrapped around mandrel wire 112. This is accomplished by payout assemblies 122 tracing an arcuate, circumnavigational path around mandrel wire guide 116. The wrapping of constituent braid wires 120 around mandrel wire 112 creates braided construct 124, which continues advancing downstream to pulley 126, where braided construct 124 turns downwardly to advance further downstream back through base plate 114. Braided construct then passes around idler 128, as shown in FIG. 13, and onto braid takeup spool 130, which may be driven by drive belt to pull mandrel wire 112 and braided construct 124 along the above-described path.

Figure 13:
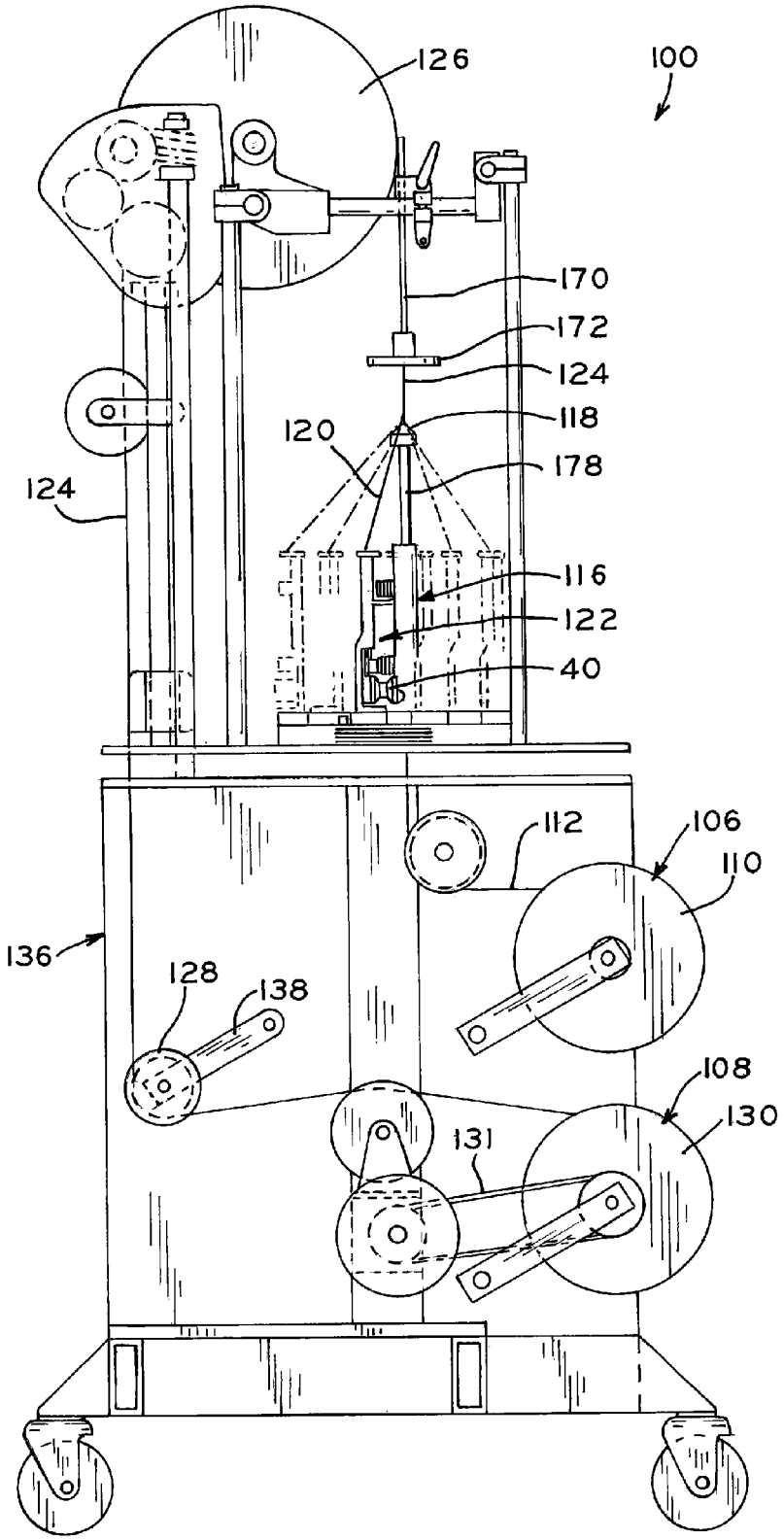
FIG. 13 is a side elevation, cross-section view of the braiding machine shown in FIG. 12.

In the exemplary embodiment illustrated in FIGS. 12 and 13, mandrel wire payout assembly 106 and braid takeup assembly 108 include pivoted arms or "dancers" 132, 134, respectively, which may allow mandrel wire spool 110 and braid takeup spool 130 to pivot about their connections to cabinet 136 to maintain even tension in mandrel wire 112 and braided construct 124, respectively during the braiding operation. Similarly, idler 128 may be mounted to pivot arm 138 to provide further accumulation in the threading path of braided construct 124 to thereby maintain even tension throughout the wire path of braiding machine 100.

Figure 14:
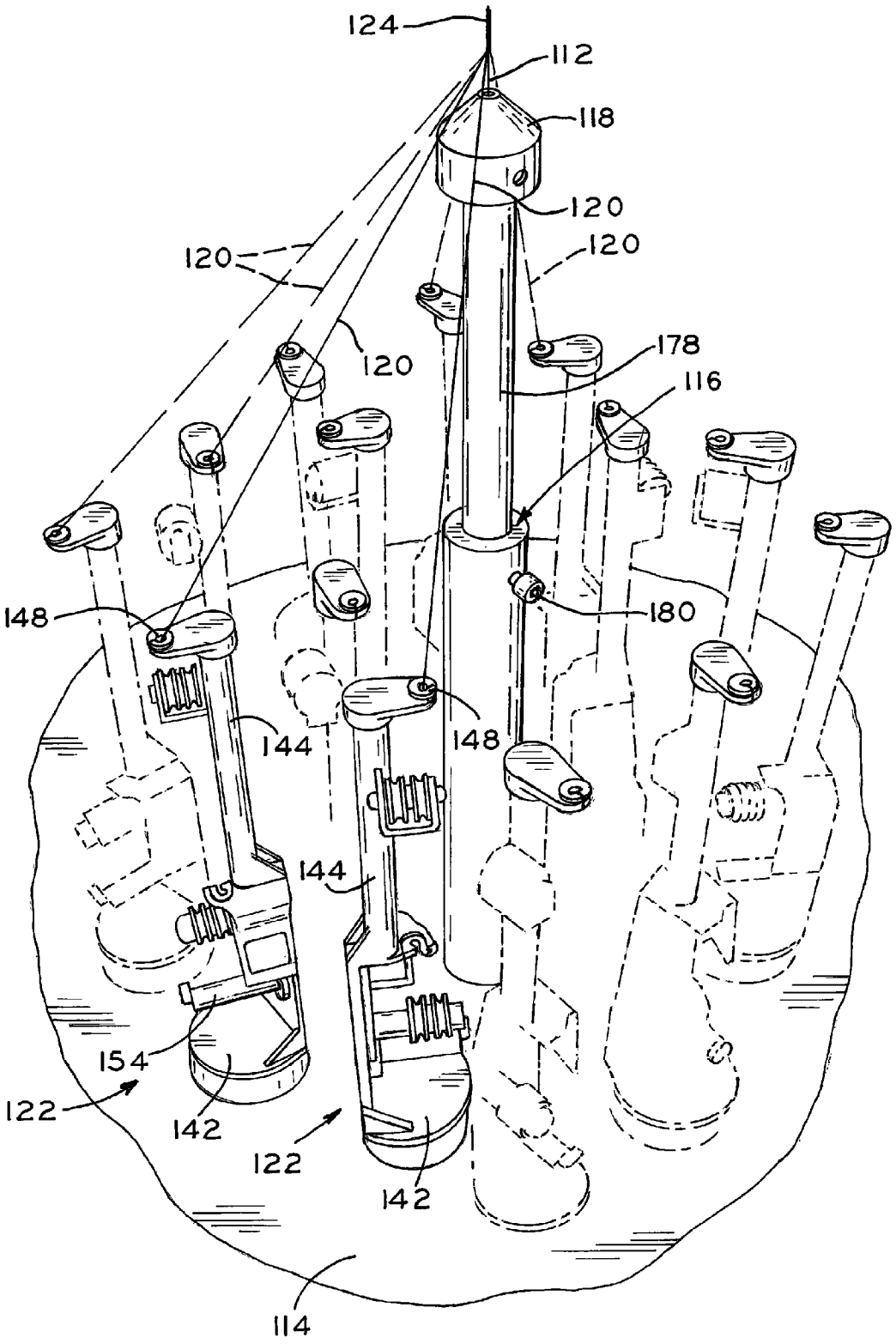
FIG. 14 is a perspective view of a plurality of constituent wire payout assemblies of the braiding machine shown in FIG. 12, illustrating the arrangement of the payout assemblies around a mandrel wire guide.

As noted above, a plurality of constituent wire payout assemblies 122 are used to feed constituent braid wires 120 into contact with mandrel wire 112 as mandrel wire 112 exits outlet 118 of mandrel wire guide 116. As best shown in FIG. 14, constituent wire payout assemblies 122 may be rotatably mounted to base plate 114 and distributed around the entire periphery of mandrel wire guide 116. Each payout assembly 122 rotates around mandrel wire guide 116, while also rotating about a separate individual axis spaced from the longitudinal axis of mandrel wire guide 116. This creates a "dance" of the various constituent wire payout assemblies 122 around mandrel wire guide 116, in which payout assemblies 122 rotate around wire guide 116 and also around their neighboring assemblies 122. This circumnavigational path causes constituent braid wires 120 to wrap around mandrel wire 112 while also selectively overlaying one another in a braid-like fashion. For clarity, only some constituent braid wires 120 are shown in FIG. 14, it being understood that constituent wires 120 may be utilized in some or all of the available payout assemblies 122 in a particular application for braiding machine 100.

One exemplary braiding machine 100 utilizing a plurality of payout assemblies 122 and an arcuate circumnavigational path of assemblies 122 around wire guide 116 and one another is available from Körting Nachfolger Wilhelm Steeger GmbH & Co KG located in Wuppertal, Germany.

Figure 1:
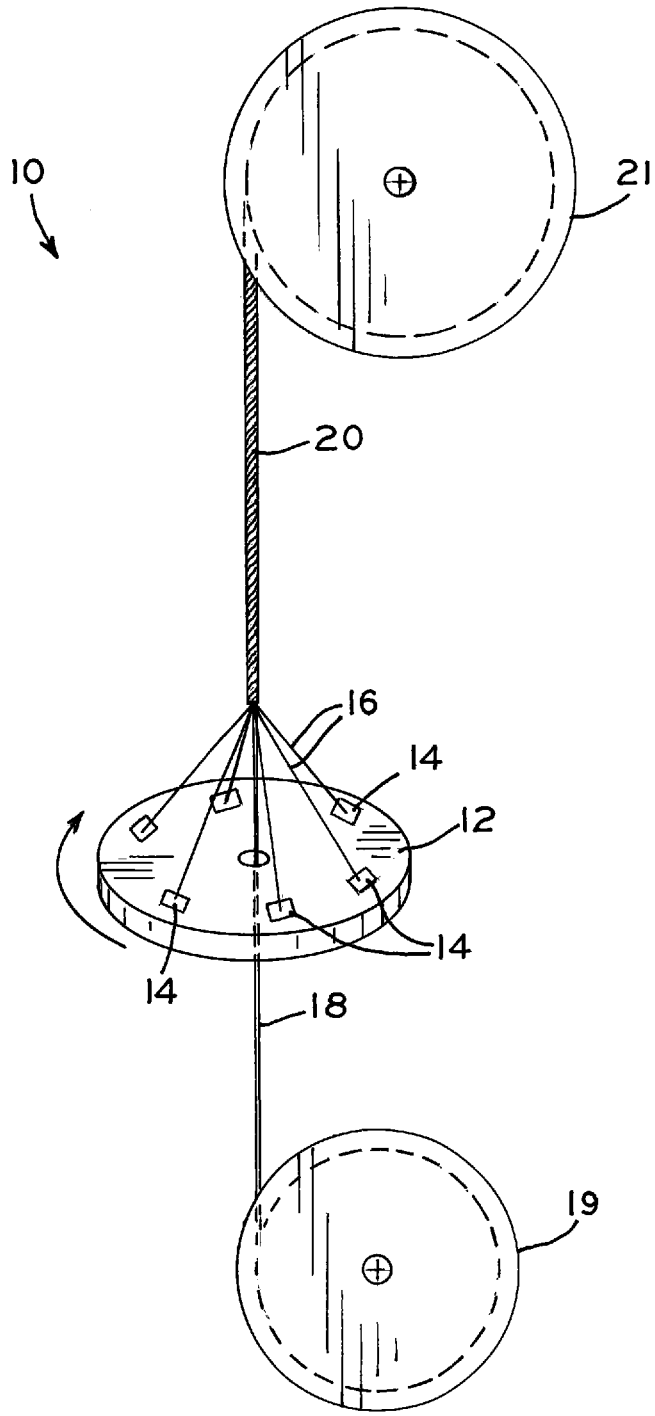
FIG. 1 is a schematic illustration of a wire braiding machine.

As constituent wires 120 are wrapped and braided around mandrel wire 112 in a desired braid pattern, braided construct 124 is created and advanced downstream to be eventually rewound as a finished product at braid takeup spool 130, as shown in FIGS. 12 and 13 and described above. For purposes of the present disclosure, any particular braid pattern for braided construct 124 may be used, as required or desired for a particular application. In one simple application, for example, a rotatable carousel 12 (FIG. 1) may be used to create a braid pattern in which constituent wires 120 wrap around mandrel wire 112 in a spiral wound pattern. Of course, other more complex braid patterns such as those provided by wire payout assemblies 122 and their associated arcuate circumnavigational paths around mandrel wire 112 and one another may also be used.

Figure 18:
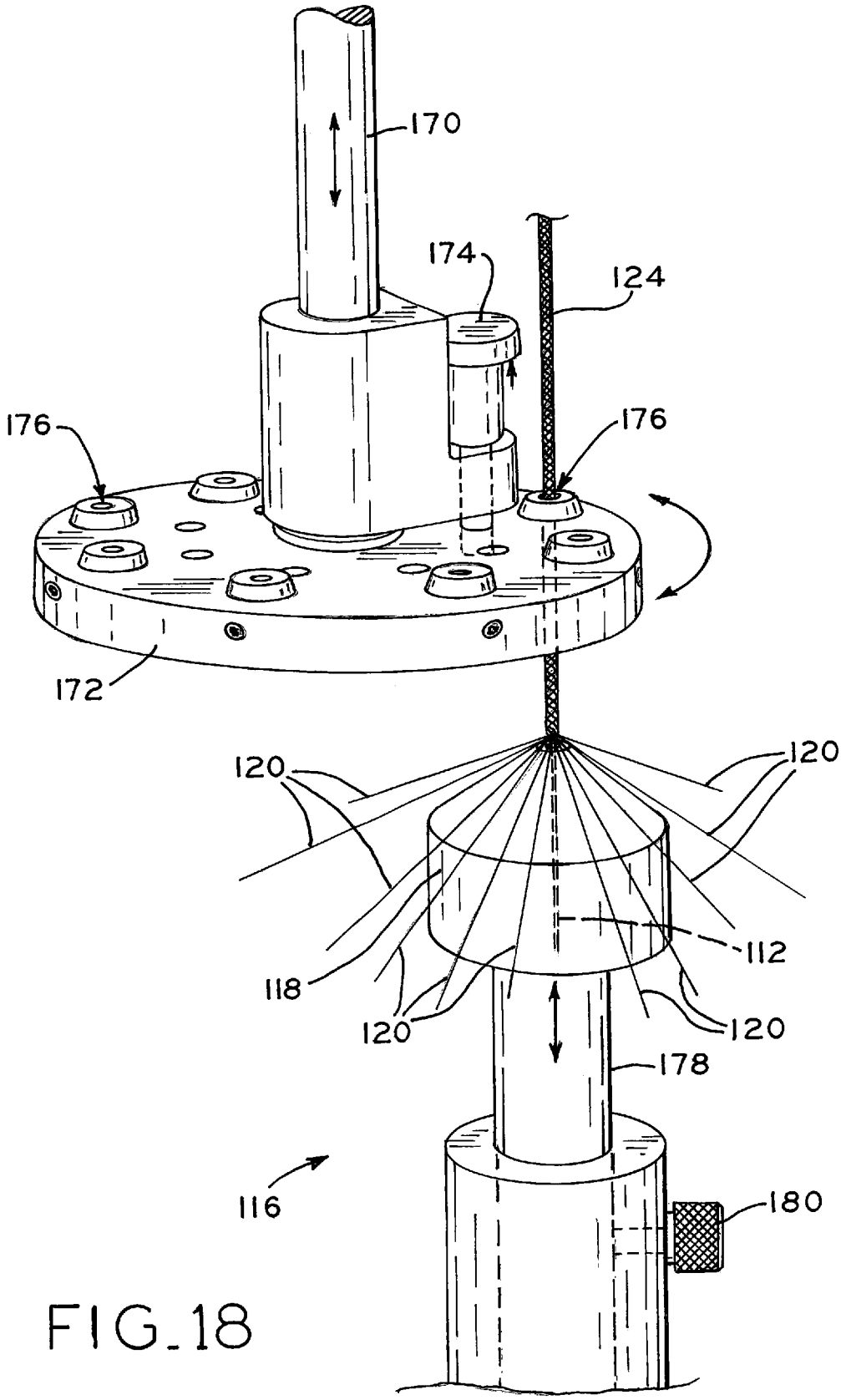
FIG. 18 is a perspective view of a downstream end of the mandrel wire guide shown in FIG. 14, illustrating creation of a braided wire construct.
Figure 19:
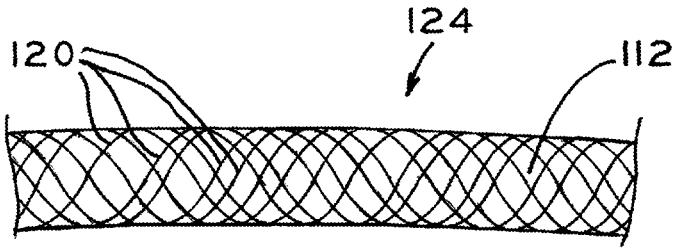
FIG. 19 is a side elevation view of the braided wire construct shown in FIG. 18.

Turning to FIG. 18, an enlarged view of the junction between mandrel wire 112 and constituent wires 120 is shown. Mandrel wire 112 emerges from outlet 118 of mandrel wire guide 116 and is intersected by constituent wires 120, before braided wire construct 124 advances downstream. As illustrated, adjustment arm 170 extends downwardly into the vicinity of outlet 118, to which guide plate 172 is slidably mounted. Guide plate 172 can be moved upwardly (i.e., downstream) or downwardly (i.e. upstream) to define how far downstream constituent wires 120 may travel before being urged into contact with mandrel wire 112. Similarly, outlet 118 may be moved upwardly or downwardly by loosening thumb screw 180 and sliding outlet plunger 178 with respect to mandrel wire guide 116. Outlet 118 is moved to define how far upstream constituent wires 120 may travel before being urged into contact with mandrel wire 112.

Guide plate 172 includes a plurality of different-sized guide apertures 176 formed around the periphery of plate 172. Release 174 is used to allow plate 172 to rotate to align a selected one of apertures 176 that is appropriately sized to allow the chose size of braided wire construct 124 to pass therethrough.

2. Wire Payout Control

Turning now to FIG. 15, in an exemplary embodiment, each constituent wire payout assembly 122 utilizes its own individual payout control mechanism 140 to facilitate maintenance of constant tension and smooth payout of constituent braid wires 120 from spool 40 during operation of braiding machine 100. Payout assembly 122 includes base 142 with arm 144 extending upwardly therefrom. Arm 144 supports elevated pulleys 146 and wire outlet 148 at a distal end thereof, as illustrated in FIG. 15. Movable lower pulleys 150 are provided at the lower (i.e., proximal) end of arm 144, and are pivotable along an arcuate path about pivot pin 152, as described in further detail below. Located below movable pulleys 150, payout assembly 122 includes spool payout arm 154 (best seen in FIG. 14) to which the central bore 60 of bobbin 40 removably rotatably mounts.

To advance constituent wire 120 from bobbin 40 toward contact with mandrel wire 112 (as described above), wire 120 is paid out from its wound arrangement on bobbin 40, rotating counterclockwise from the perspective of FIGS. 15-17, and upwardly through eyelet 156. Wire advances downstream along thread path $T_1$ to inside elevated pulley 146 (i.e., the pulley 146 located nearer arm 144). Wire 120 extends around inside pulley 146 and back downwardly along thread path $T_2$, then around inside lower pulley 150 and back upwardly along thread path $T_3$ to outside upper pulley 146. Wire 120 extends around outside upper pulley 146 and back downwardly again along thread path $T_4$ to outside lower pulley 150, where a final turn around outside lower pulley 150 sends wire 120 upwardly along thread path $T_5$ to wire outlet 148. Upon emerging from outlet 148, wire 120 advances further downstream to contact mandrel wire 112 as shown in FIG. 14.

This relatively long thread path for braid wire 120 cooperates with wire payout control mechanism 140, as shown in FIGS. 16 and 17, to promote consistent tension within braid wire 120 during operation of braiding machine 100 and the associated payout of braid wire 120 from bobbin 40. Turning to FIG. 16, movable lower pulleys 150 are each rotatably mounted to pivot arm 158, which in turn is rotatably mounted to a portion of base 142 by pivot pin 152, such that pivot arm 158 and pulleys 150 are rotatable about pivot pin axis $L_W$ through an arcuate path. For example, as shown in FIGS. 17, pulleys 150 and pivot arm 158 are shown in an upwardly pivoted position as compared to the position of FIG. 16. However, a spring biased plunger 160 extends downwardly from within arm 144 to bear against pivot arm 158, urging arm 158 and pulleys 150 into their lower position, i.e., closest to bobbin 40 as shown in FIG. 16.

Turning back to FIG. 15, as tension increases within constituent braid wire 120, lower pulleys 150 are drawn upwardly toward upper pulleys 146. When such tension in wire 120 is sufficient to overcome the downwardly biasing force of plunger 160, movable pulleys 150 and pivot arm 158 are pivoted upwardly about axis $L_W$ of pivot pin 152. As this upward pivoting motion occurs, pivot arm 158 is withdrawn from contact with protrusion 164 formed in ratchet arm 162, as shown by a comparison of FIGS. 16 and 17 (FIG. 16 showing contact between protrusion 164 and pivot arm 158, while FIG. 17 shows space therebetween). Ratchet arm 162, which is also rotatably mounted to pivot pin 152 and able to pivot about axis $L_W$, is for a time held downwardly against ratchet teeth 48 by only its own weight, and not by the biasing force of plunger 160. When pivot arm 158 approaches the top of its pivot stroke, however, ratchet arm lifter 168 (FIG. 17) formed on a lower surface of pivot arm 158 engages the undersurface of ratchet arm 162, as illustrated in FIG. 17. This engagement lifts ratchet arm 162 upwardly so that ratchet arm 162 pivots from the solid line orientation to the dashed line orientation of FIG. 17, thereby disengaging tooth 166 of ratchet arm 162 from ratchet 48 and freeing bobbin 40 to rotate and advance a length of constituent braid wire 120 downstream along thread path $T_1$ (FIG. 15).

This introduction of an additional length of braid wire 120 into thread paths $T_1$ through $T_5$ reduces the tension in wire 120, which may in some instances allow movable pulleys 150 and pivot arm 158 to pivot downwardly around axis $L_W$ under the biasing force of plunger 160. If such downward pivoting occurs, tooth 166 ratchet arm 162 re-engages the next adjacent stop face 64 of ratchet 48 formed on bobbin 40. This re-engagement will halt any further rotation of bobbin 40 until pivot arm 158 is again lifted under tension in wire 120, in turn withdrawing ratchet arm 162 from engagement with ratchet 48. This tension/payout cycle serially continues to feed braid wire 120 downstream while avoiding any slackening or over-tensioning of wire 120.

Thus, the system of wire accumulation through threading paths $T_1$ through $T_5$, together with the movement of pulleys 150 and action of the anti-backlash ratcheting mechanism provided by cooperation between ratchet arm 162, ratchets 48 and the adjacent structures, all cooperate to helps smooth out any sudden changes in tension of braid wire 120 during payout from bobbin 40. However, the limits of this tension control system can be reached and breached if braid wire 120 is not smoothly paid out from bobbin 40. For example, if wire 120 is too tightly nested between other adjacent wire windings on bobbin 40, the sudden increase in tension can overwhelm the accumulation and tension control mechanisms of constituent wire payout assembly 122 and cause constituent wire 120 to slacken or break.

However, as described in detail above, provision of bobbin 40 with tapered surfaces 46 minimizes or eliminates the potential for uneven tension within wound wire on bobbin 40, thereby ensuring smooth and uninterrupted wire payout from bobbin 40. Thus, as further detailed in the examples below, bobbin 40 can be filled to capacity with constituent braid wires 120 (i.e., wire 120 can completely occupy volume 50), while also paying out the entire length of such wire with no snags or breaks through constituent wire payout assembly 122.

EXAMPLES

The following non-limiting Example illustrates various features and characteristics of the present disclosure, which is not to be construed as limited thereto.

Prophetic Example 1

The spools of FIGS. 4A-11 can used to receive wire 120 having a diameter of less than 1 mm, and in some cases less than or equal to 0.10 mm. A first end of the wire is engaged within the wire winding slot, and the wire is then continuously wound onto spool 40 in a layered, side-by-side alternating fashion as viewed from a side of spool 40, with successive layers of wire 120 overlapping one another as wire 120 is wound onto spool 40. The "bi-tapered" design of spool 40 permits the width of the layers, as viewed from the side of spool 40, to continuously increase as the wire layers are built up radially outwardly onto spool 40 along a wire winding direction transverse to the longitudinal axis $L_1$-$L_1$ of barrel 42 of spool 40. After a desired amount of wire 120 is wound onto spool 40, wire 120 is cut to provide a second end which is then secured to the spool, such as via a piece of tape.

Figure 2:
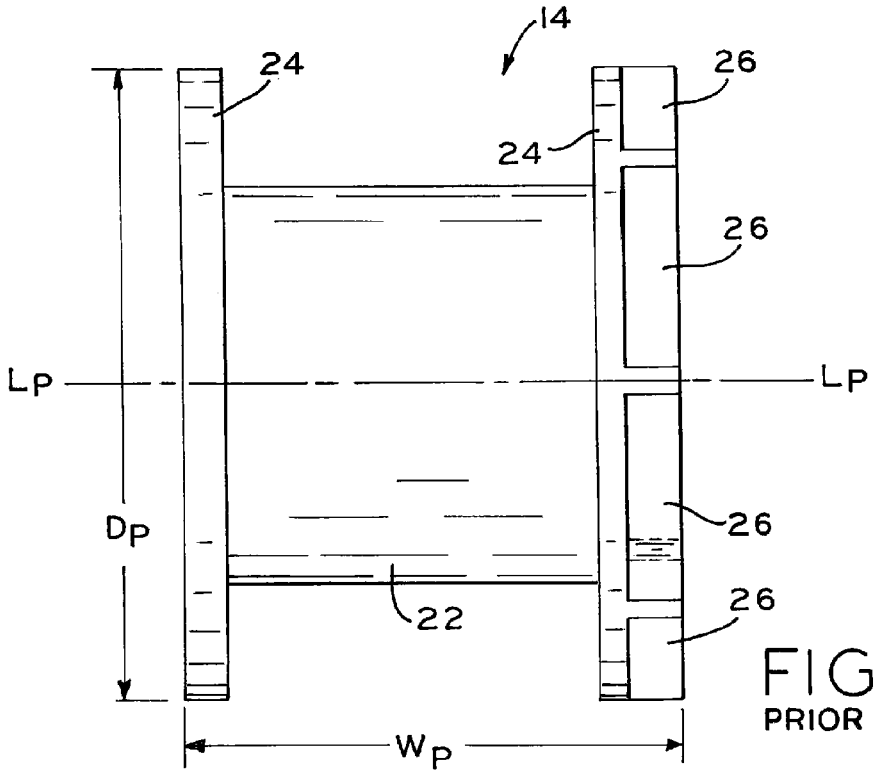
FIG. 2 PRIOR ART
FIG. 2 is a side elevation view of a known spool.
Figure 3A:
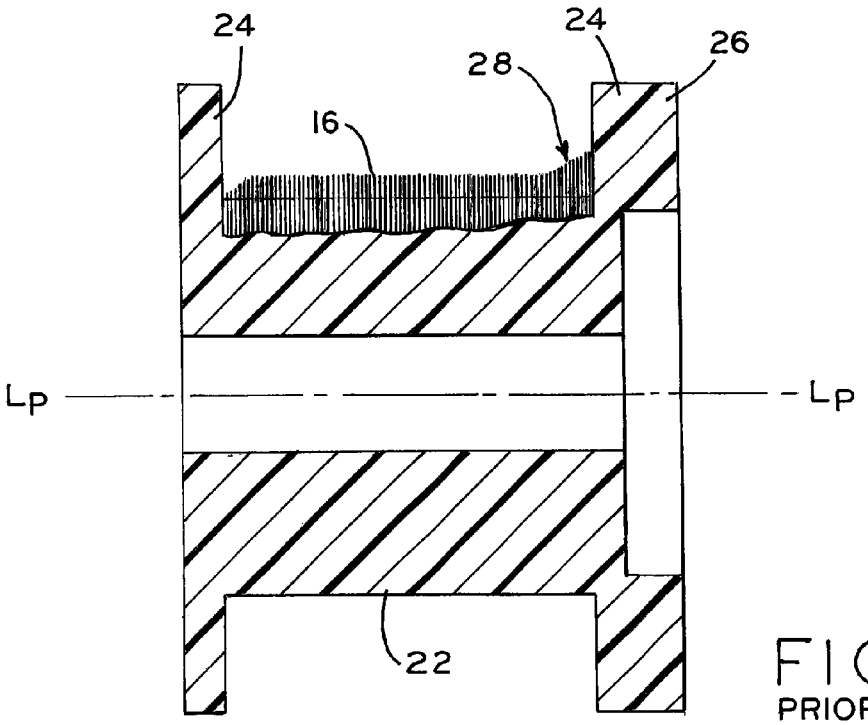
FIG. 3A PRIOR ART
FIG. 3A is side elevation, cross-section view of the known spool of FIG. 2, including a partial breakaway, schematic illustration of wire wound thereon and including a wire winding defect.
Figure 3B:
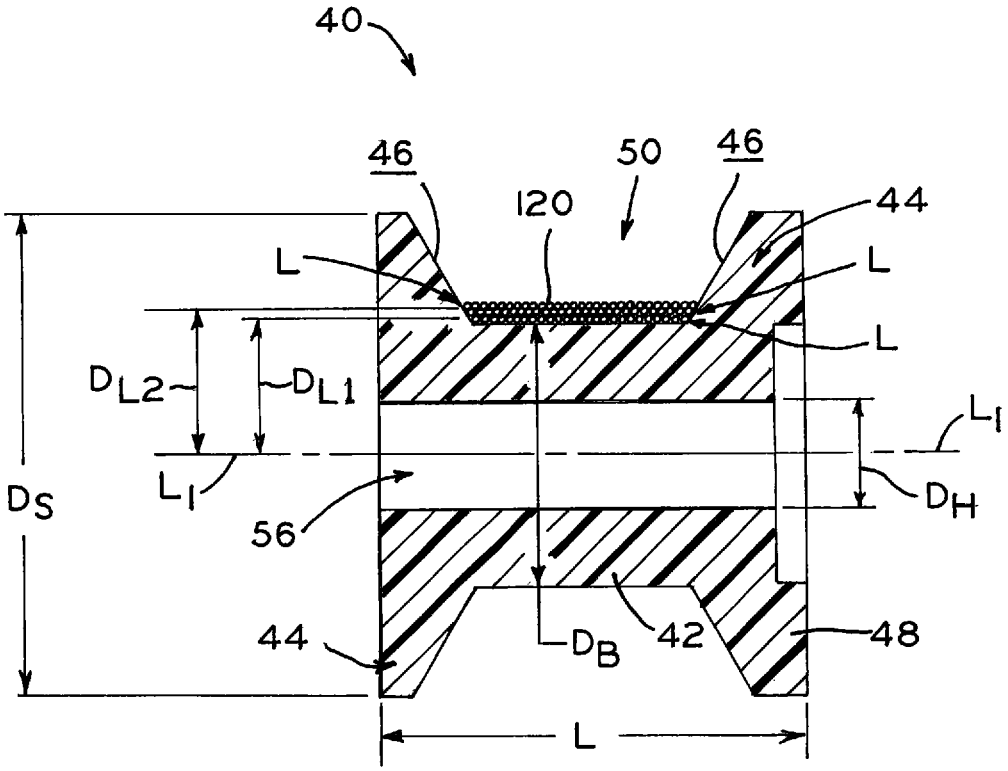
FIG. 3B is side elevation, cross-section view of a spool made in accordance with the present disclosure, including a partial schematic illustration of wire wound thereon.

When several such spools are used in a wire braiding machine, the occurrence of wire snagging is reduced as compared with use of the spool of FIGS. 2 and 3A with the same wire.

Working Example 1

1. EXPERIMENTAL TECHNIQUE

In this working example, several bobbins made in accordance with the present disclosure, and having different geometrical parameters, were tested in a braiding machine made by Kórting Nachfolger Wilhelm Steeger GmbH & Co KG, illustrated as braiding machine 100 in FIGS. 12-18. As a control, known bobbins lacking a tapered profile (e.g., bobbin 14 shown in FIG. 2) were also tested under the same conditions as the present bobbins.

Standard statistical methods, including Taguchi methods for Design of Experiments, were used to evaluate the effect of seven factors on the performance of the wire braiding machine. The performance of the trials was evaluated based upon the number of wire breaks occurring during a run of the machine. A break was defined as a fracture in a single braiding wire anywhere within the payoff carrier (which causes the braiding machine to stop operation).

Figure 20:
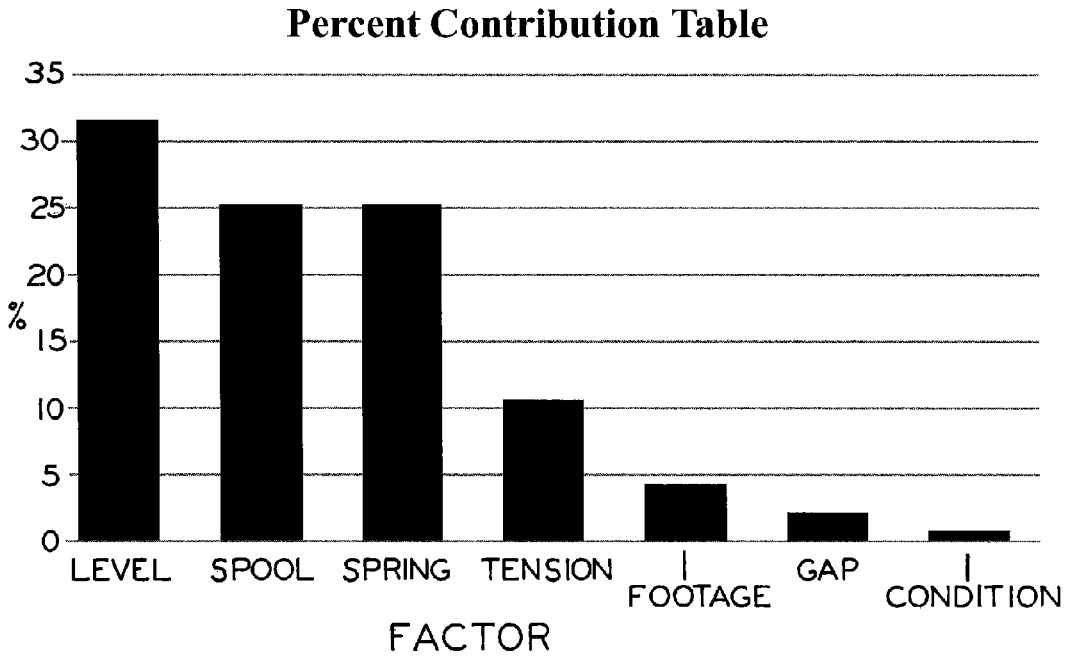
FIG. 20 is a graph illustrating the relative contributions of various braiding machine factors in wire breakage during payout from a bobbin.
Figure 21A:
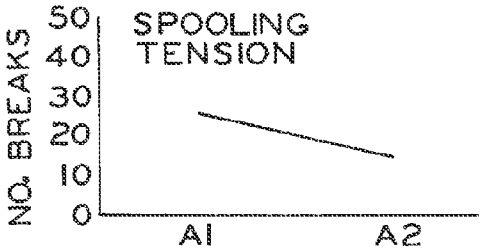
FIGS. 21A-21G are graphs illustrating the results of tests performed on various bobbins on a braiding machine.
Figure 21B:
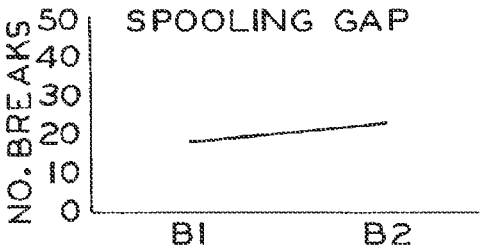
Figure 21C:
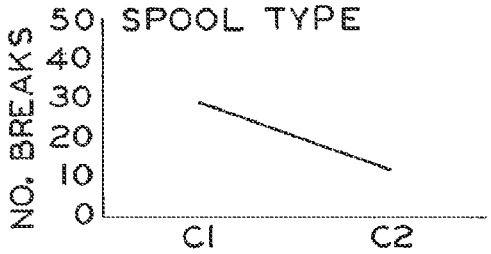
Figure 21D:
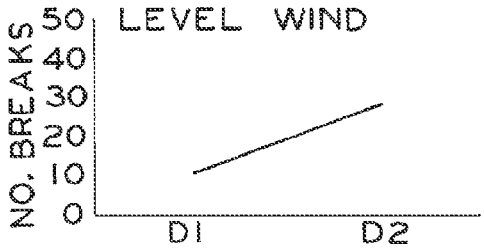
Figure 21E:
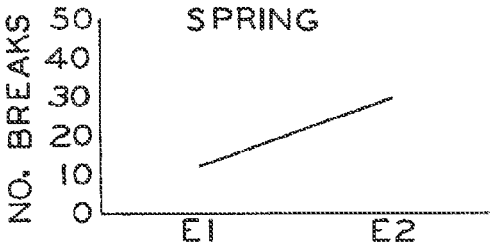
Figure 21F:
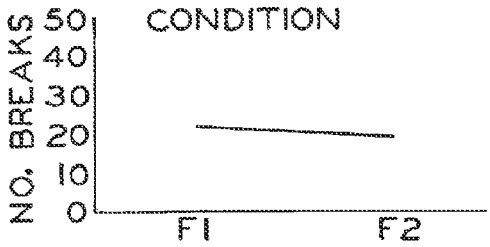
Figure 21G:
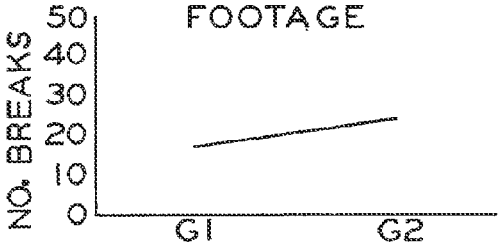

Percent contribution of the various factors, as such factors relate to the frequency of wire breaks, was determined from the data collected during the trial runs. The bar chart shown in FIG. 20 presents this calculation graphically, with percent contribution on the Y-axis and each factor called out on the X-axis. The larger the percent contribution, the more prevalent the identified factor is in influencing the occurrence or absence of wire breaks (and, therefore, in obtaining the desired outcome of fewer wire breaks).

Each factor is controllable either during the winding of constituent wire 120 onto spool 40, or by operation of braiding machine 100. More particularly, the "Tension" factor is the tension applied to wire 120 as it is wound onto spool 40. The "Gap" factor is the space imparted between each respective wire winding from the adjacent windings, also imparted by the wire-winding operator as wire 120 as it is wound onto spool 40. The "Spool" factor refers to the type of spool being used, e.g., bi-tapered spool 40 or known spool 14 shown in FIG. 2A. "Level Wind" refers to how the wire layers L (FIG. 3B) are wound, i.e., a level wind with a constant distance $D_{LX}$ across the axial extent of a given layer L, or a non-level wind with a non-constant distance $D_{LX}$ across the axial extent of layer L. "Footage" refers to the length of wire 120 wound onto spool 40. "Spring" refer to the "strength" or spring constant of the biasing element urging plunger 160 downwardly (described above with respect to FIGS. 16 and 17), and is controlled by the operator of braiding machine 100. "Condition" refers to the tensile strength of the particular wire 120 being wound onto the bobbin.

Within the context of the contribution of spool design to wire breaks, several sub-sets of spool design parameters were also tested. For these tests, all other factors discussed above were kept constant (i.e., level wind, spring, tension, footage, gap and condition). The performance of the trials was assessed by the number of breaks occurring during any particular test run. The resulting data is graphically depicted in FIGS. 22A-24C and discussed in detail below.

2. RESULTS

The line graphs of FIGS. 21A-21G illustrate comparisons of bobbin performance for each factor shown in FIG. 20 and discussed above. The Y-axes of each of the graphs in FIGS. 21A-21G correspond to the number of wire breaks observed during testing; for purposes of the present Working Example, a smaller Y-axis value represents a reduced sensitivity to the given factor in producing favorable outcome (i.e., fewer wire breaks). The X-axis of each of the graphs shows two discrete "levels"—level 1 on the left portion of the X-axis and level 2 on the right portion of the X-axis. For each factor, the respective levels were set as shown in Table 1:

TABLE 1

| Factor Settings | | | |
|---|---|---|---|
| | | Level | |
| FIG. | Factor | 1 | 2 |
| 21A | Tension | Lower | Higher |
| 21B | Gap | Smaller | Larger |
| 21C | Spool | 90 Degree | Bi-Tapered |
| 21D | Level Wind | Level | Non-Level |
| 21E | Spring | Low-constant | High-constant |
| 21F | Condition | Annealed | Spring |
| 21G | Footage | Shorter | Longer |

As a result of this comparison, it was determined that the factors resulting in the fewest wire breaks were: (i) good level winds; (ii) the use of a bi-tapered spool in accordance with the present disclosure; (iii) a relatively weaker spring constant as between two springs tested with plunger 160; and (iv) a 0.24 lb tension applied to constituent wire 120 during the winding process. More particularly, the use of a bi-tapered spool 40 in accordance with the present disclosure exhibited a 25% contribution to producing a favorable outcome as compared to the known spools, thereby evidencing a significantly superior result using spools 40. For the follow-on experiments comparing spools 40 as discussed below, all other factors remained constant and in accordance with the most favorable factor parameters listed above.

Figure 22A:
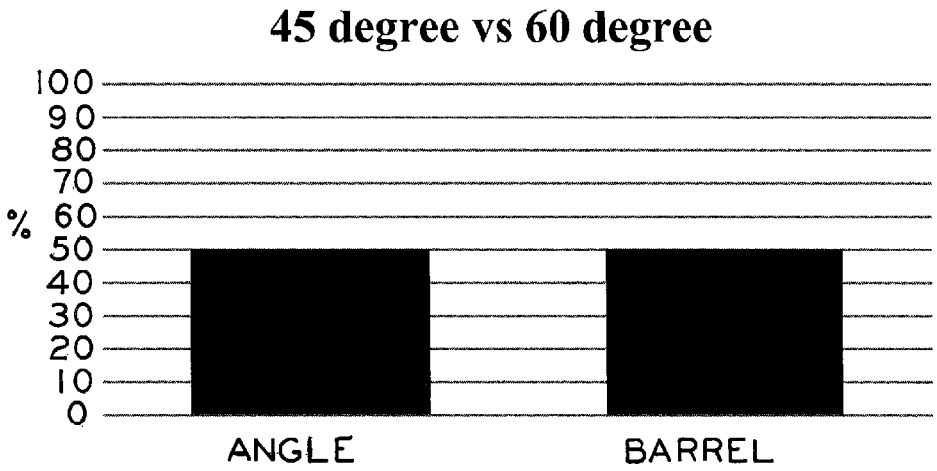
FIGS. 22A-22C are graphs illustrating the results of tests performed on bobbins made in accordance with the present disclosure.
Figure 22B:
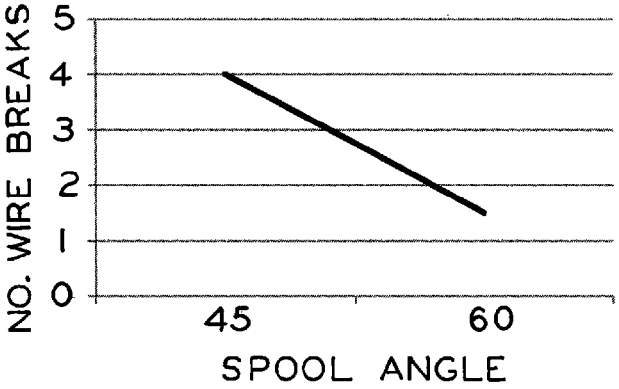
Figure 22C:
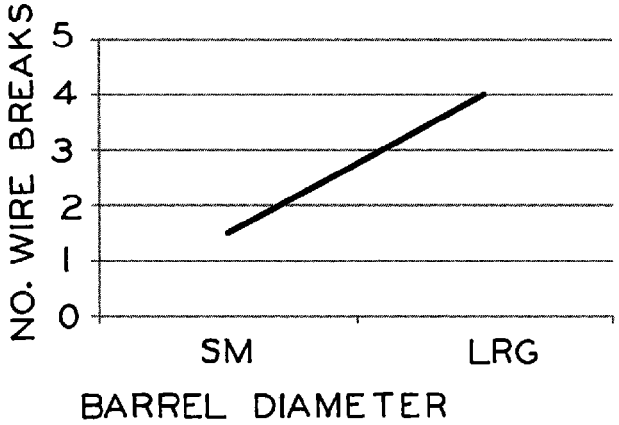

FIGS. 22A-22C graphically illustrate data collected from a comparison of spools 40 having respective angles Θ of 45 degrees and 60 degrees and barrel diameters $D_B$ of 0.756 inches (for "small barrel" spools) and 1.02 inches (for "large barrel" spools). As shown in FIG. 22A, no significant difference in the contribution of angle Θ and barrel diameters $D_B$ were shown by this set of trials. However, FIG. 22B illustrates that significant improvement in minimizing the total number of breaks was realized by using spools 40C and 40D, whose angle Θ is 60 degrees, as compared to spools 40A and 40B, whose angle Θ is 45 degrees. In addition, FIG. 22C illustrates that significant improvement in minimizing the total number of breaks was realized by using spools 40A and 40D, having "small" barrel diameters $D_B$ of 0.756 inches, as compared to spools 40B and 40C, having "large" barrel diameters $D_B$ of 1.02 inches.

This data shows that both the angle Θ and the barrel diameters $D_B$ of spool 40 can significantly affects the occurrence of wire breaks. In this set of trials, the optimum spool was spool 40D, having angle Θ of 60 degrees and diameter $D_B$ of 0.756 inches.

Figure 23A:
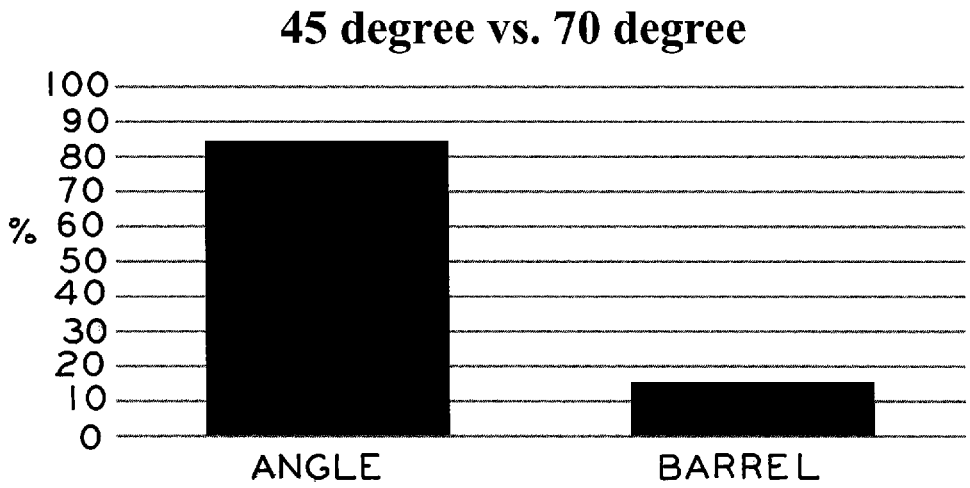
FIGS. 23A-23C are additional graphs illustrating the results of tests performed on bobbins made in accordance with the present disclosure.
Figure 23B:
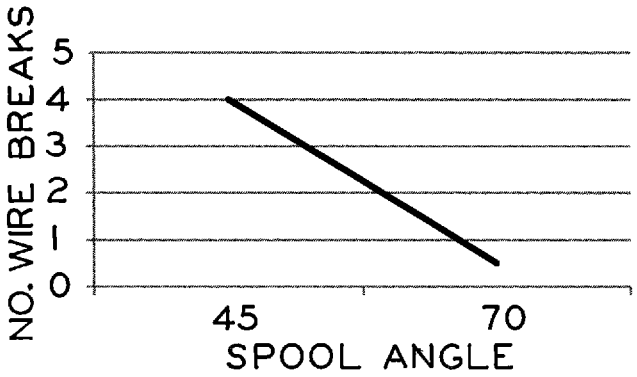
Figure 23C:
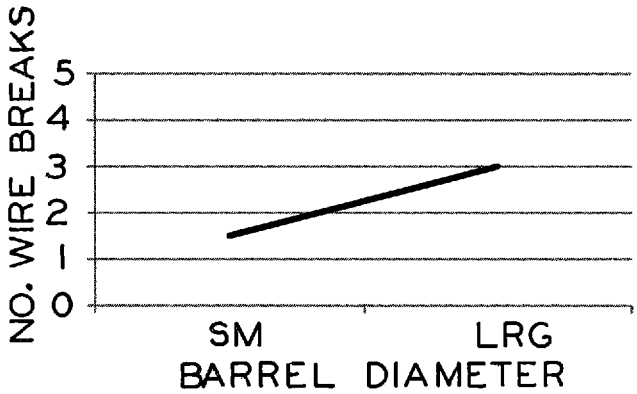

Turning now to FIGS. 23A-23C, these figures graphically illustrate data collected from a comparison of spools 40 having respective angles Θ of 45 degrees and 70 degrees, and the same small (0.756 inches) and large (1.02 inches) barrel diameters $D_B$ discussed above with respect to FIGS. 22A-22C. As shown in FIG. 23A, the contribution of angle Θ was found to be significantly larger than that of barrel diameters $D_B$ in this set of trials. Moreover, FIG. 23B illustrates that significant improvement in minimizing the total number of breaks was realized by using spools 40E and 40F, whose angle Θ is 70 degrees, as compared to spools 40A and 40B, whose angle Θ is 45 degrees. FIG. 23C illustrates that a smaller, but still significant improvement in minimizing the total number of breaks was realized by using spools 40A and 40F, having "small" barrel diameters $D_B$ of 0.756 inches, as compared to spools 40B and 40E, having "large" barrel diameters $D_B$ of 1.02 inches.

This data shows that both the angle Θ is a more prevalent factor than barrel diameter $D_B$ in reducing the occurrence of wire breaks. In this set of trials, the optimum spool was spool 40F, having angle Θ of 70 degrees and diameter $D_B$ of 0.756 inches.

Figure 24A:
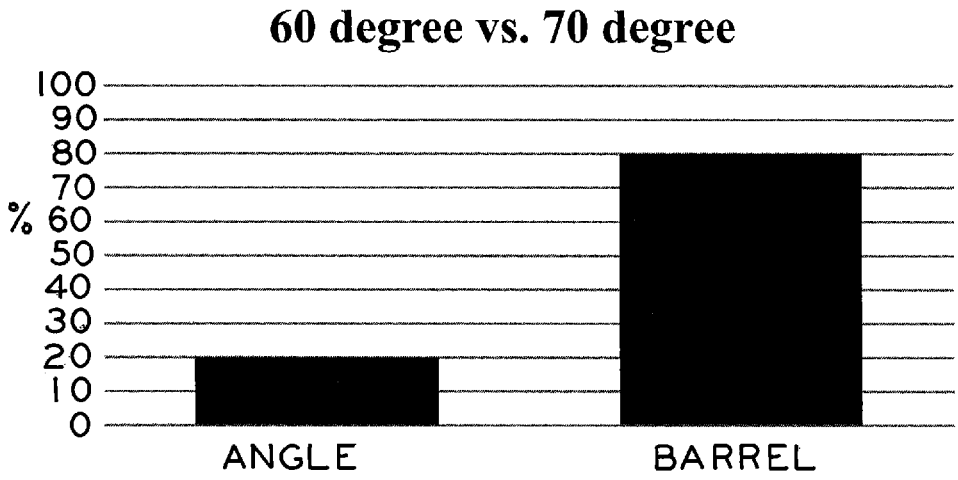
FIGS. 24A-24C are additional graphs illustrating the results of tests performed on bobbins made in accordance with the present disclosure.
Figure 24B:
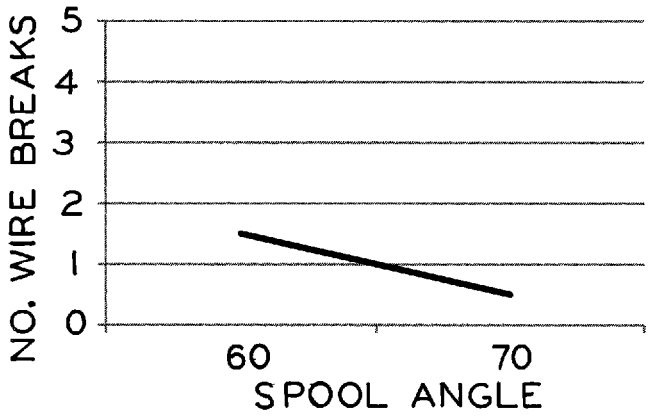
Figure 24C:
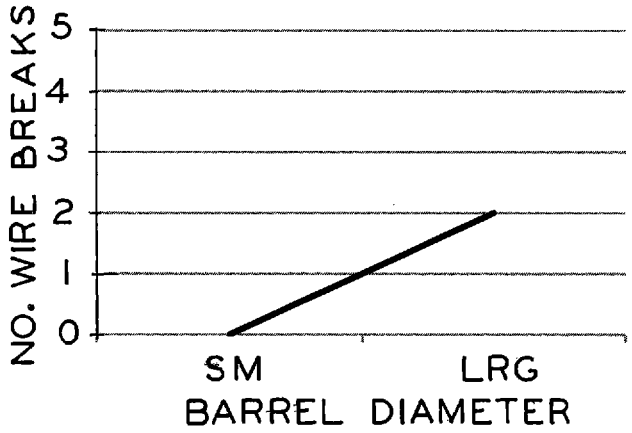

Turning now to FIGS. 24A-24C, these figures graphically illustrate data collected from a comparison of spools 40 having respective angles Θ of 60 degrees and 70 degrees, and the same small (0.756 inches) and large (1.02 inches) barrel diameters $D_B$ discussed above with respect to FIGS. 22A-23C. As shown in FIG. 24A, the contribution of barrel diameters $D_B$ was found to be large than that of angle Θ in this set of trials, though neither has a particularly profound effect on wire breaks as described below with respect to FIGS. 24B and 24C. More specifically, FIG. 24B illustrates that only a slight improvement in the total number of breaks between spools 40E and 40F, whose angle Θ is 70 degrees, as compared to spools 40C and 40D, whose angle Θ is 60 degrees. FIG. 24C illustrates that a small but significant improvement in minimizing the total number of breaks was again realized by using spools 40D and 40F, having "small" barrel diameters $D_B$ of 0.756 inches, as compared to spools 40C and 40E, having "large" barrel diameters $D_B$ of 1.02 inches.

This data shows no statistically significant difference between angle Θ of 60 or 70 degrees, but again demonstrates that using the smaller barrel diameter $D_B$ is a significant factor in reducing the occurrence of wire breaks. In this set of trials, the optimum spool was again spool 40F, having angle Θ of 70 degrees and diameter $D_B$ of 0.756 inches, though spool 40D also performed well.

3. CONCLUSION

The overall analysis shows that bi-tapered spool 40 reduces the probability that a wire breaks will occurring during operation of wire braiding machine 100. Furthermore, an angle Θ of 60-70 degrees, combined with a barrel diameter $D_B$ of 0.756 inches, further reduces this probability in the context of the various fine wire bobbins 40 tested.

From these results, it may be concluded that angling surfaces 46 of spools 40 in accordance with the present disclosure serves to reduce the likelihood of wire breaks during payoff of constituent wire 120, and, further, that setting angle Θ at 60-70 degrees, and barrel diameter $D_B$ of 0.756 inches further minimizes such likelihood.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A braiding machine comprising:

a mandrel wire payout assembly including a mandrel wire spool rotatably mounted to a first spool support;

a mandrel wire guide positioned to receive a mandrel wire from said mandrel wire payout assembly, such that a mandrel wire path includes an upstream origin at said mandrel wire payout assembly and a downstream portion passing through said mandrel wire guide;

a braid takeup assembly disposed downstream of said mandrel wire guide, said braid takeup assembly including a braid takeup spool rotatably mounted to a second spool support;

a plurality of payout assemblies rotatably arranged around said mandrel wire guide, each of said plurality of payout assemblies comprising:

a payout arm;

a constituent wire guide disposed downstream of said payout arm, said constituent wire guide positioned to guide a constituent wire of a braided wire construct from said payout arm to said mandrel wire path downstream of said mandrel wire guide; and a ratcheting mechanism disposed adjacent one end of said payout arm; and a spool rotatably mountable to one of said plurality of payout assemblies, said spool comprising:

a barrel having a central bore defining a longitudinal axis; said central bore sized to be received on said payout arm;

a pair of tapered sections extending axially away from respective opposing axial ends of said barrel to define a pair of opposed flanges of said spool, said pair of tapered sections comprising frusto-conical sections defining an angle with said longitudinal axis of said barrel, said angle between 35 degrees and 75 degrees, said barrel and said pair of tapered sections defining a wire spooling volume of said spool;

a quantity of metallic wire wound around said barrel to form a plurality of layers extending progressively radially outwardly from the longitudinal axis, the plurality of layers respectively extending between and abutting the pair of tapered sections; and a plurality of ratchet teeth formed on an axial end surface of one of said pair of tapered sections, said ratchet teeth adapted to selectively engage said ratcheting mechanism of said payout assembly.

2. The braiding machine of claim 1, wherein said wire spooling volume is between 0.623 cubic inches and 1.840 cubic inches.

3. The braiding machine of claim 2, wherein said quantity of metallic wire wound on said spool is disposed within a cylindrical envelope defined by an outer diameter of said pair of tapered sections and an overall axial length of said spool, said quantity of wire having a length of at least 1,000 feet.

4. The braiding machine of claim 1, wherein said angle is about between 60 degrees and 70 degrees.

5. The braiding machine of claim 1, wherein said pair of tapered sections have a parabolic profile and define a concave surface.

6. The braiding machine of claim 1, wherein each of said plurality of payout assemblies comprises a plurality of pulleys adapted to receive said a wire from said spool, said pulleys spaced away from one another to define a thread path advancing both away from and toward said spool.

7. The braiding machine of claim 6, wherein said plurality of pulleys includes at least one pulley rotatably mounted to a pivot arm such that said pulley is pivotable away from said spool when the wire received on said pulley experiences tension, said pivot arm operable to engage said ratcheting mechanism with said ratchet teeth when said pulley is not pivoted away from said spool, and said pivot arm operable to disengage said ratcheting mechanism from said ratchet teeth when said pulley is pivoted away from said spool.

8. The braiding machine of claim 7, further comprising a biasing element acting on said pivot arm to urge said pivot arm toward said spool.

9. The braiding machine of claim 1, wherein said quantity of metallic wire defines a round cross-section having a diameter between 0.00075 inches and 0.004 inches.

10. The braiding machine of claim 1, wherein said quantity of metallic wire defines a rectangular cross-section having a width between 0.002 inches and 0.012 inches, and a height between 0.0007 inches and 0.004 inches.

11. A braiding machine comprising:

a mandrel wire payout assembly including a mandrel wire spool rotatably mounted to a first spool support;

a mandrel wire guide positioned to receive a mandrel wire from said mandrel wire payout assembly, such that a mandrel wire path includes an upstream origin at said mandrel wire payout assembly and a downstream portion passing through said mandrel wire guide;

a braid takeup assembly disposed downstream of said mandrel wire guide, said braid takeup assembly including a braid takeup spool rotatably mounted to a second spool support;

a plurality of payout assemblies rotatably arranged around said mandrel wire guide, each of said plurality of payout assemblies comprising:

a payout arm;

a constituent wire guide disposed downstream of said payout arm, said constituent wire guide positioned to guide a constituent wire of a braided wire construct from said payout arm to said mandrel wire path downstream of said mandrel wire guide; and a ratcheting mechanism disposed adjacent one end of said payout arm; and a spool rotatably mountable to one of said plurality of payout assemblies, said spool comprising:

a barrel having a central bore defining a longitudinal axis, said central bore sized to be received on said payout arm;

a pair of frusto-conical tapered sections extending axially away from respective opposing axial ends of said barrel to define a pair of opposed flanges of said spool, said barrel and said pair of tapered sections defining a wire spooling volume of said spool between 0.623 cubic inches and 1.840 cubic inches, said pair of frusto-conical tapered sections defining an angle with said longitudinal axis of said barrel between 35 degrees and 75 degrees;

a quantity of fine metallic wire having a length of at least 1,000 feet and wound around said barrel, such that said quantity of fine metallic wire is contained within said spooling volume; and a plurality of ratchet teeth formed on an axial end surface of one of said pair of frusto-conical tapered sections, said ratchet teeth adapted to selectively engage said ratcheting mechanism of said payout assembly.

12. The braiding machine of claim 11, wherein said spooling volume is within a cylindrical envelope defined by an outer diameter of said pair of tapered sections and an overall axial length of said spool.

13. The braiding machine of claim 12, wherein said quantity of metallic wire is wound around said barrel to form a plurality of layers extending progressively radially outwardly from the longitudinal axis, the plurality of layers respectively extending between and abutting the pair of tapered sections.

14. The braiding machine of claim 13, wherein said quantity of metallic wire defines a round cross-section having a diameter between 0.00075 inches and 0.004 inches.

15. The braiding machine of claim 13, wherein said quantity of metallic wire defines a rectangular cross-section having a width between 0.002 inches and 0.012 inches, and a height between 0.0007 inches and 0.004 inches.

16. A braiding machine comprising:

a mandrel wire payout assembly including a mandrel wire spool rotatably mounted to a first spool support;

a mandrel wire guide positioned to receive a mandrel wire from said mandrel wire payout assembly such that a mandrel wire path includes an upstream origin at said mandrel wire payout assembly and a downstream portion passing through said mandrel wire guide;

a braid takeup assembly disposed downstream of said mandrel wire guide, said braid takeup assembly including a braid takeup spool rotatably mounted to a second spool support;

a plurality of payout assemblies rotatably arranged around said mandrel wire guide, each of said plurality of payout assemblies comprising:

a payout arm;

a constituent wire guide disposed downstream of said payout arm, said constituent wire guide positioned to guide a constituent wire of a braided wire construct from said payout arm to said mandrel wire path downstream of said mandrel wire guide; and a ratcheting mechanism disposed adjacent one end of said payout arm; and a spool rotatably mountable to one of said plurality of payout assemblies, said spool comprising:

a barrel having a central bore defining a longitudinal axis, said central bore sized to be received on said payout arm;

a pair of frusto-conical tapered sections extending axially away from respective opposing axial ends of said barrel to define a pair of opposed flanges of said spool, said barrel and said pair of tapered sections defining a wire spooling volume of said spool between 0.623 cubic inches and 1.840 cubic inches, said pair of frusto-conical tapered sections defining an angle with said longitudinal axis of said barrel between 35 degrees and 75 degrees;

a quantity of fine metallic wire wound on said spool and disposed within a cylindrical envelope defined by an outer diameter of said pair of tapered sections and an overall axial length of said spool, said metallic wire having a fine-wire diameter between 0.00075 inches and 0.004 inches; and a plurality of ratchet teeth formed on an axial end surface of one of said pair of tapered sections, said ratchet teeth adapted to selectively engage said ratcheting mechanism of said payout assembly.

17. The braiding machine of claim 16, wherein said quantity of metallic wire is wound around said barrel to form a plurality of layers extending progressively radially outwardly from the longitudinal axis, the plurality of layers respectively extending between and abutting the pair of tapered sections.

18. The braiding machine of claim 17, wherein said quantity of metallic wire defines a round cross-section.

19. The braiding machine of claim 17, wherein said quantity of wire has a length of at least 1,000 feet.

* * * * *